US012111140B2

(12) United States Patent
Maurer et al.

(10) Patent No.: US 12,111,140 B2
(45) Date of Patent: Oct. 8, 2024

(54) PROJECTILE AND FIREARM SYSTEM

(71) Applicant: Crossbullet, LLC, Nunnelly, TN (US)

(72) Inventors: Paul K. Maurer, Nunnelly, TN (US); Brett E. Maurer, Rochester, NY (US); Todd F. Maurer, Franklin, TN (US); Paul Della Torre, Nunnelly, TN (US); Robert Tuchrelo, Williamson, NY (US); Nathan E. Smith, Hamlin, NY (US); Richard T. Aab, Fairport, NY (US)

( * ) Notice: Subject to any disclaimer, the term of this patent is extended or adjusted under 35 U.S.C. 154(b) by 0 days.

(21) Appl. No.: 17/743,106

(22) Filed: May 12, 2022

(65) Prior Publication Data

US 2022/0373308 A1 Nov. 24, 2022

Related U.S. Application Data

(60) Provisional application No. 63/187,667, filed on May 12, 2021.

(51) Int. Cl.
*F42B 10/06* (2006.01)
*F42B 5/067* (2006.01)

(52) U.S. Cl.
CPC ..... *F42B 10/06* (2013.01); *F42B 5/067* (2013.01)

(58) Field of Classification Search
CPC ..... F42B 10/06; F42B 5/067
See application file for complete search history.

(56) References Cited

U.S. PATENT DOCUMENTS

| | | | | |
|---|---|---|---|---|
| 2,045,833 A | | 6/1936 | Childs | |
| 3,151,412 A | | 10/1964 | Swindle | |
| 3,292,879 A | | 12/1966 | Chilowsky | |
| 3,516,326 A | * | 6/1970 | Donner | F41A 21/18 89/14.05 |
| 3,566,528 A | | 3/1971 | Musser | |
| 3,690,595 A | * | 9/1972 | Rusbach | F42B 10/14 102/348 |
| 3,756,539 A | * | 9/1973 | Donner | F42B 10/06 244/91 |
| 3,759,184 A | | 9/1973 | Blajda et al. | |
| 3,897,729 A | | 8/1975 | Schirneker | |

(Continued)

FOREIGN PATENT DOCUMENTS

| | | |
|---|---|---|
| FR | 493507 A | 8/1919 |
| FR | 1297569 A | 6/1962 |

(Continued)

OTHER PUBLICATIONS

International Search Report and Written Opinion for PCT/US2022/029011, mailed Aug. 11, 2022, entire document.

(Continued)

*Primary Examiner* — Justin M Benedik
(74) *Attorney, Agent, or Firm* — Brian B. Shaw, Esq.; Harter Secrest & Emery LLP

(57) ABSTRACT

A cartridge is disclosed with a casing and a projectile, wherein external ballistic stability is provided by a center of pressure of the projectile being rearward of a center of mass of the projectile. The projectile includes flight control surfaces that cooperate with the bore of a barrel without requiring rifling or sabots. The projectile can include fin configurations that cooperate with the bore to form a gas check.

20 Claims, 12 Drawing Sheets

(56) References Cited

U.S. PATENT DOCUMENTS

| | | | |
|---|---|---|---|
| 4,077,147 | A | 3/1978 | Donnard et al. |
| 4,524,695 | A | 6/1985 | Bisping et al. |
| H112 | H | 8/1986 | Donovan et al. |
| 4,723,472 | A | 2/1988 | Lee |
| 4,829,904 | A | 5/1989 | Sullivan |
| 4,869,148 | A | 9/1989 | Tucker |
| 5,079,986 | A | 1/1992 | Lee |
| 5,400,716 | A | 3/1995 | Mayer |
| 5,557,871 | A | 9/1996 | LaLonde |
| 5,686,693 | A | 11/1997 | Jakobsson |
| 6,655,293 | B1 | 12/2003 | Henry et al. |
| 8,291,828 | B2 | 10/2012 | Glasser |
| 8,735,789 | B1 | 5/2014 | Malejko et al. |
| 9,581,402 | B2 | 2/2017 | Minnicino, II |
| 9,644,929 | B1 | 5/2017 | Bradbury et al. |
| 10,352,669 | B2 | 7/2019 | Fournier et al. |
| 11,353,302 | B1 | 6/2022 | Steffner |
| 11,408,717 | B2 | 8/2022 | Robbins et al. |
| 2020/0309491 | A1 | 10/2020 | Berger |

FOREIGN PATENT DOCUMENTS

| | | | |
|---|---|---|---|
| GB | 125817 | A | 5/1919 |
| GB | 742841 | A | 1/1956 |
| RU | 2064643 | C1 | 7/1996 |

OTHER PUBLICATIONS

DeSousa, Luis (2010) "Developments in Short Range Training Ammunition" General Dynamics Ordnance and Tactical Systems-Canada Inc., 1-22.

Pike, J. (2000) "Big Bullets for Beginners" http://www.fas.org/man/dod-101/sys/land/bullets2.htm, 1-13.

United States Statutory Invention Registration H112, published by the United States Patent and Trademark Office on Aug. 5, 1986.

* cited by examiner

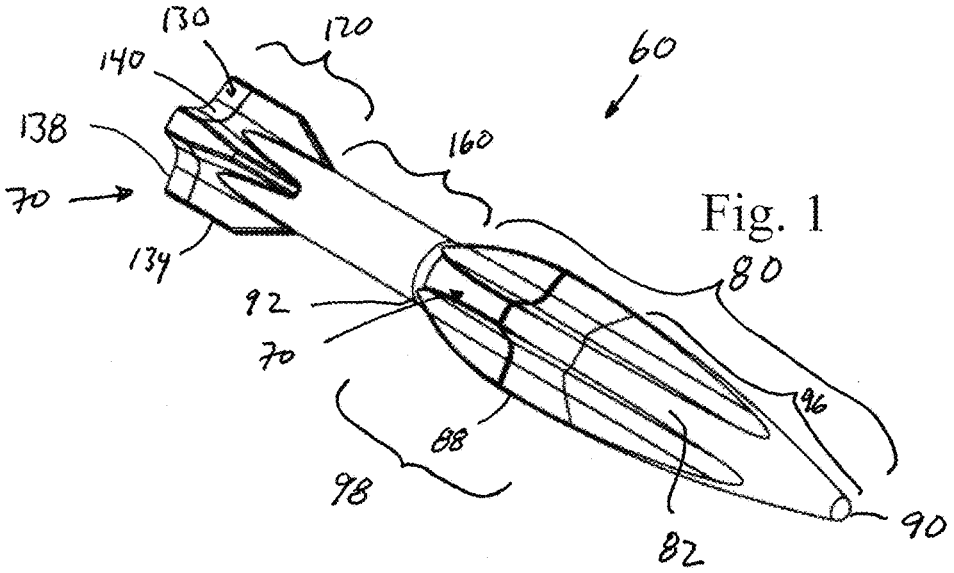
Fig. 1
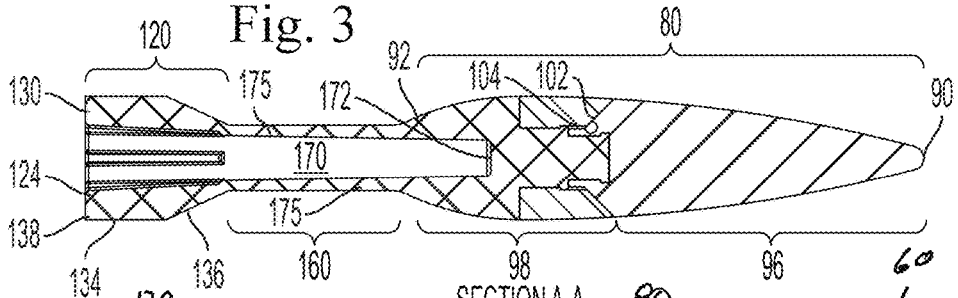
Fig. 3
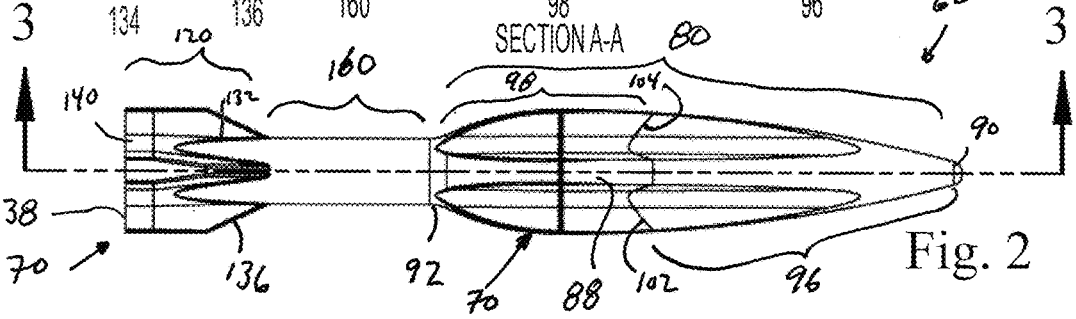
Fig. 2
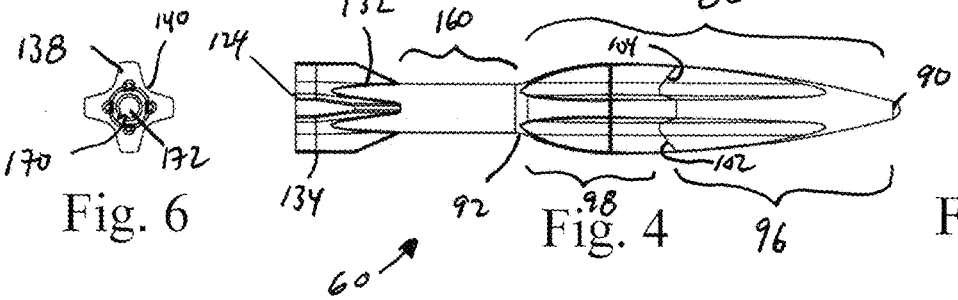
Fig. 6
Fig. 4
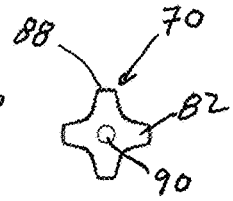
Fig. 5

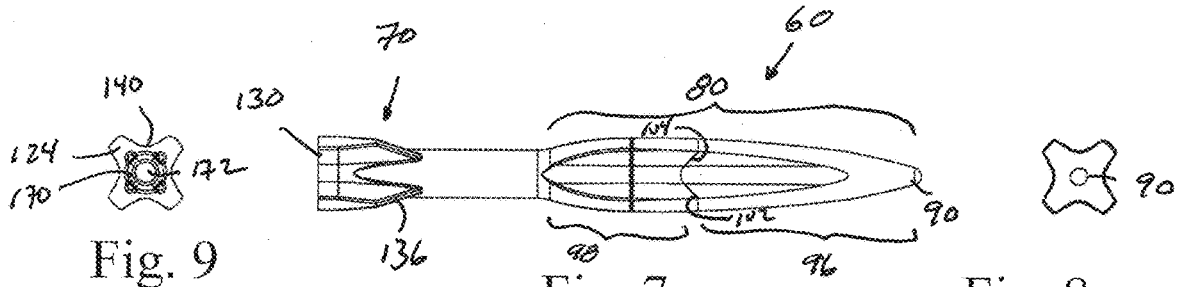
Fig. 9
Fig. 7
Fig. 8
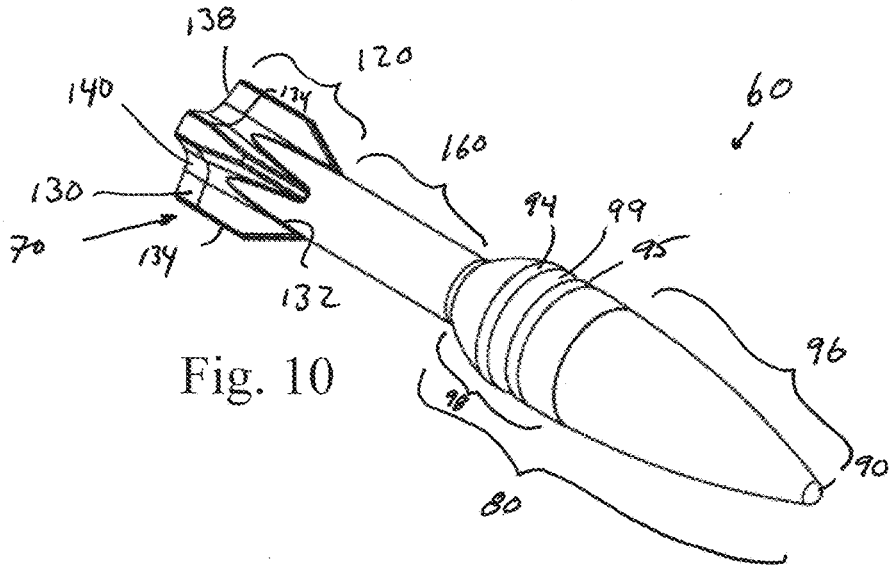
Fig. 10

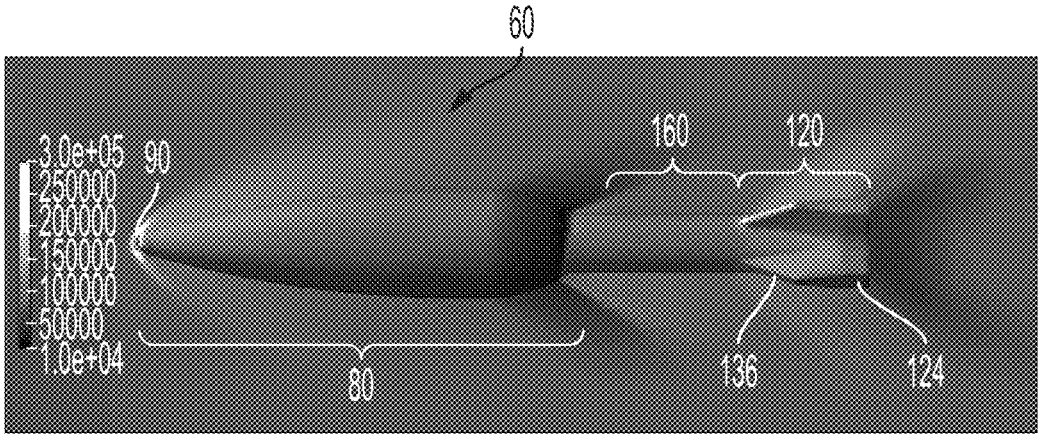
Fig. 19
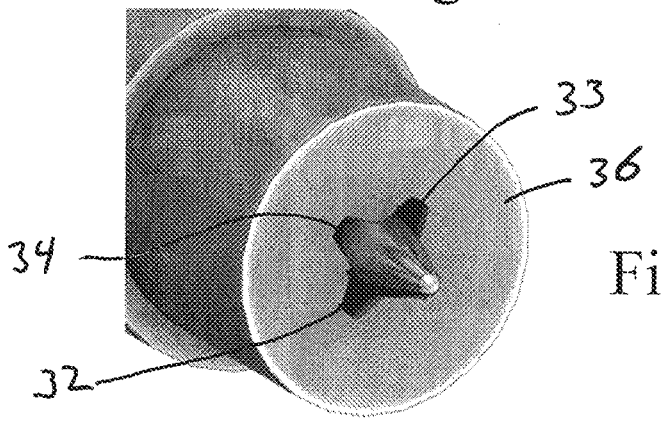
Fig. 20
Fig. 21
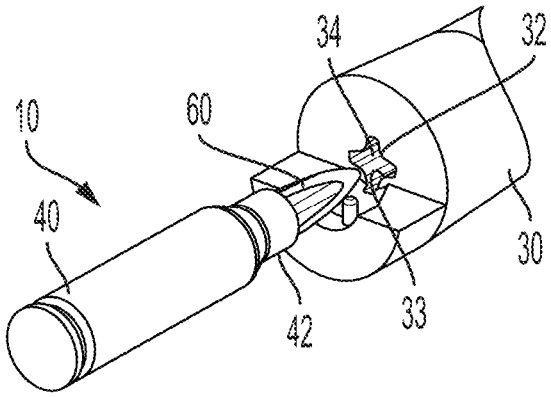
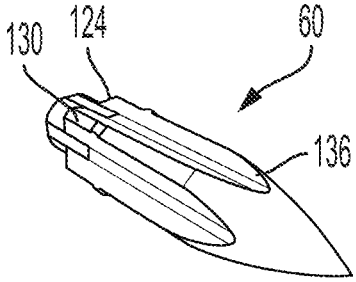
Fig. 22

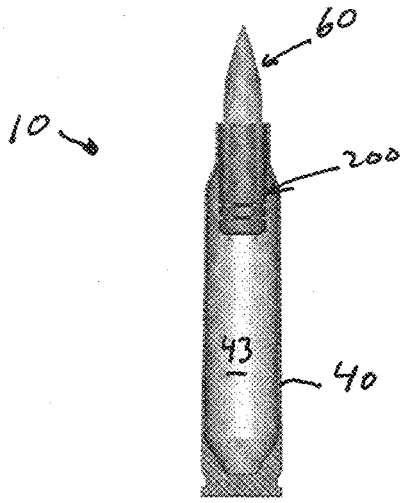
Fig. 23
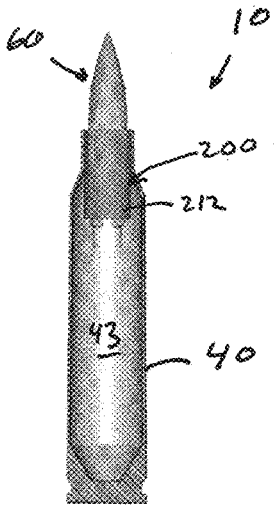
Fig. 24
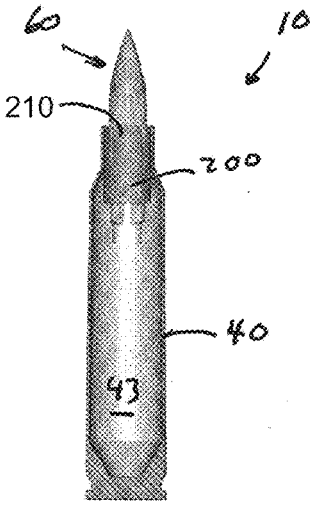
Fig. 25
Fig. 26
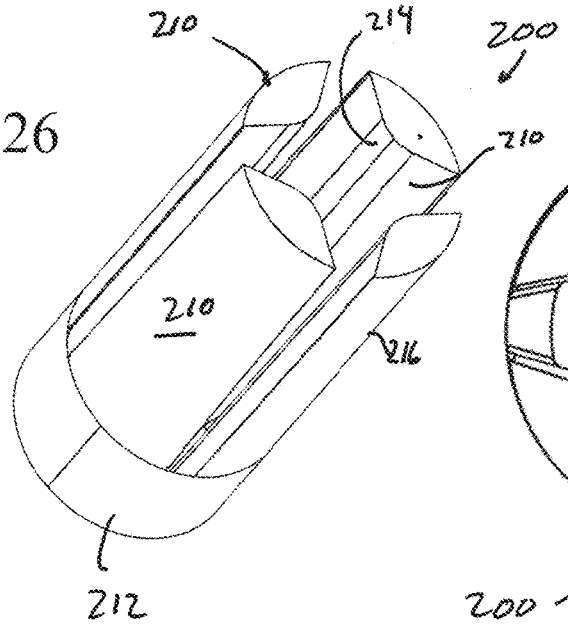
Fig. 27
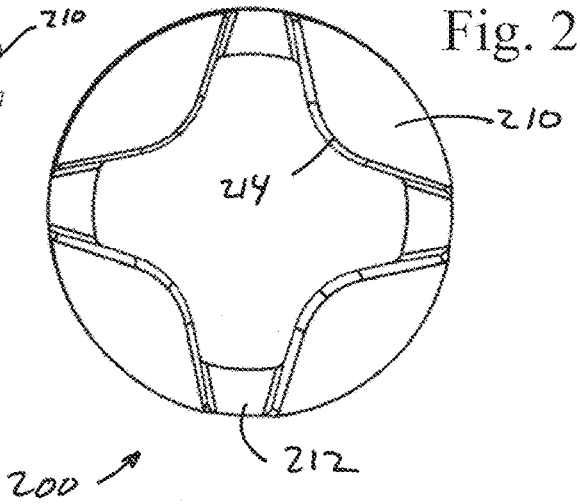

Fig. 32
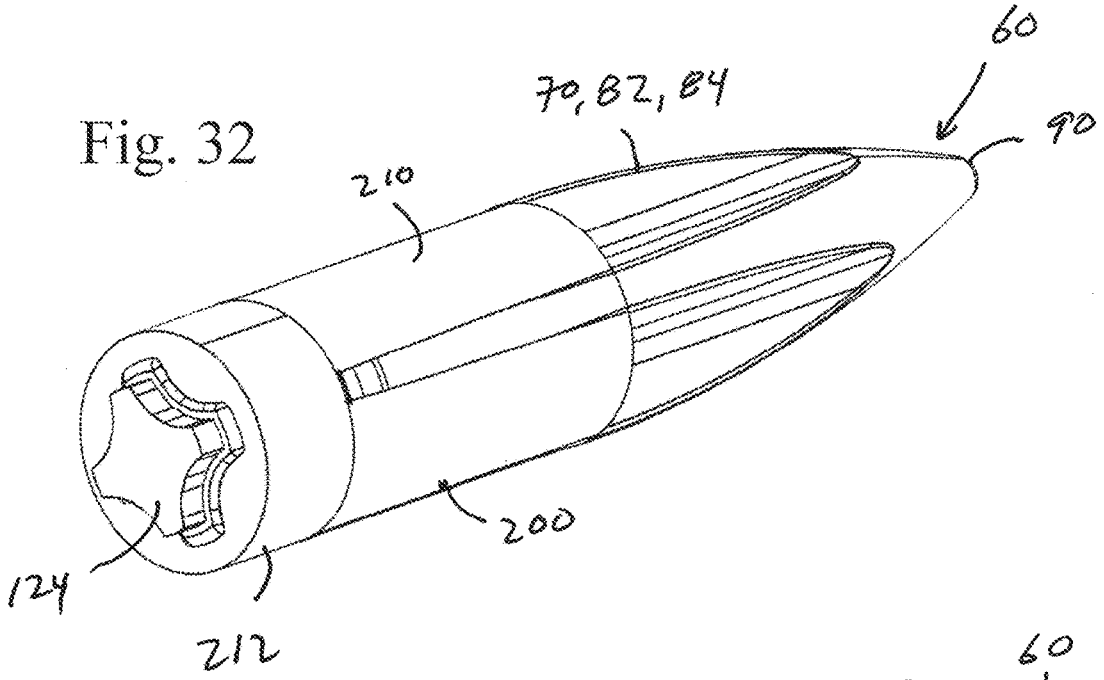
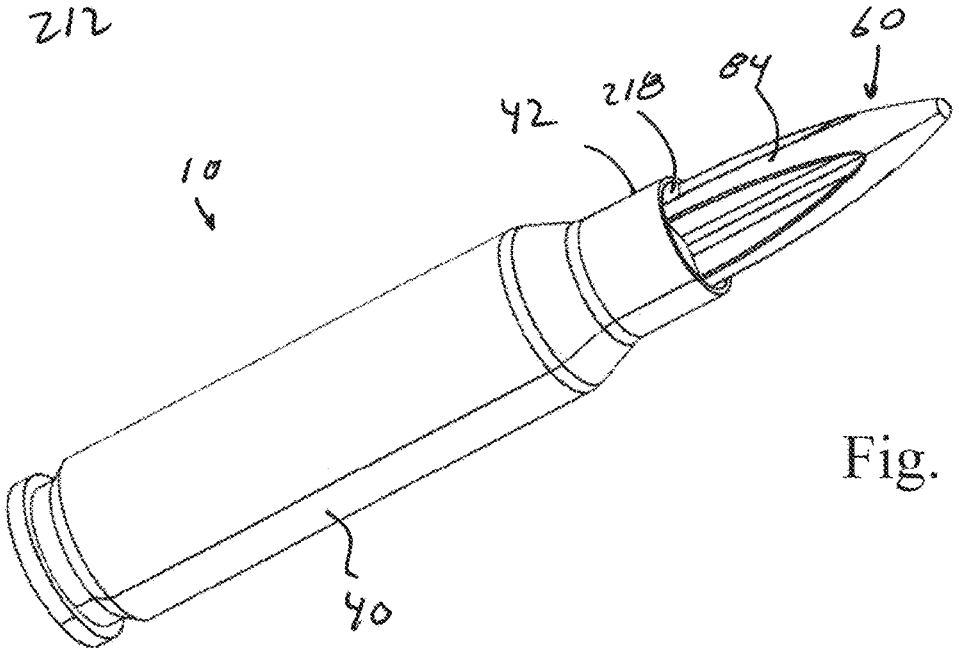
Fig. 33

Fig. 37
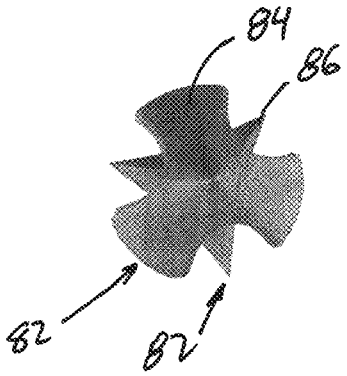
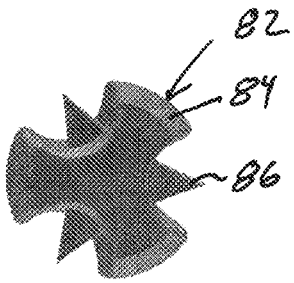
Fig. 38
Fig. 39
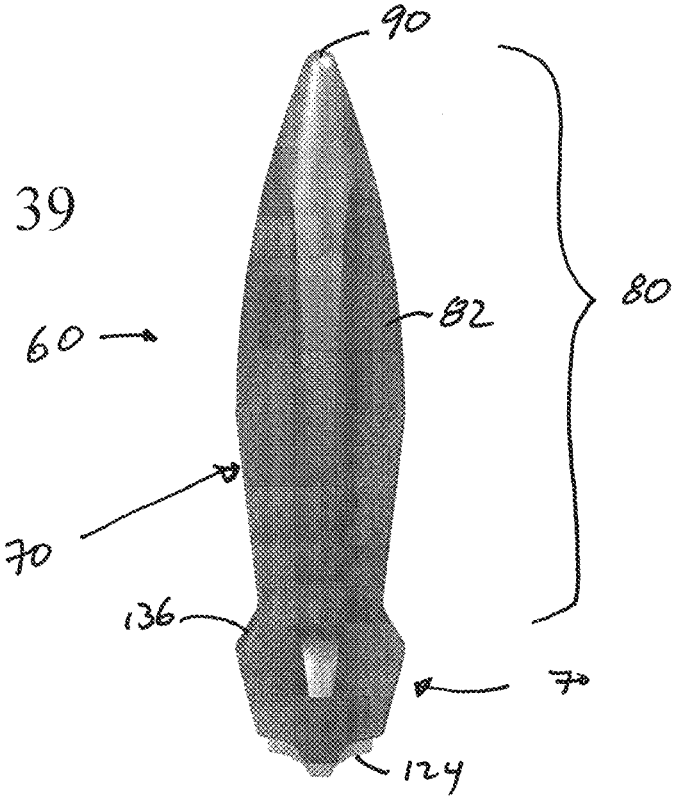
Fig. 40
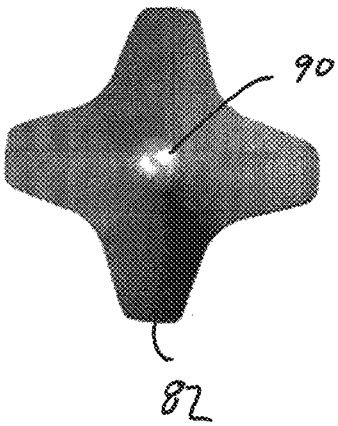
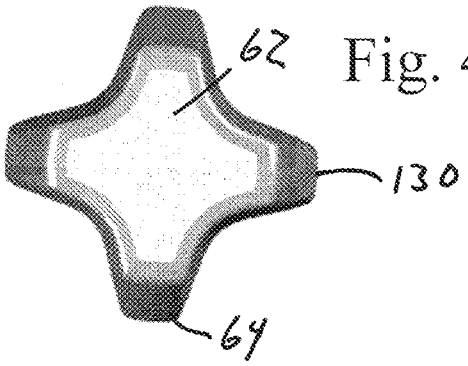
Fig. 41

Fig. 44
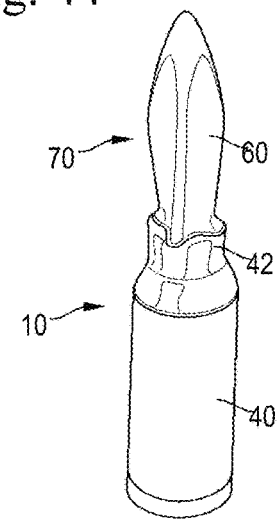
Fig. 45
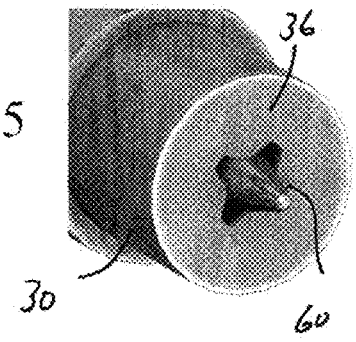
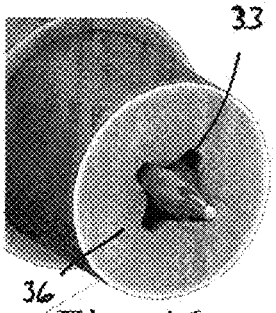
Fig. 46
Fig. 47
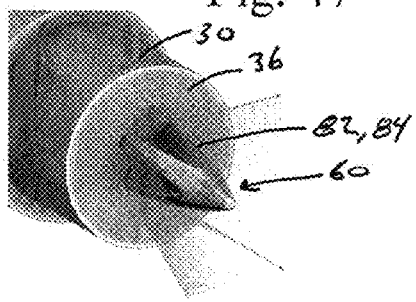
Fig. 48
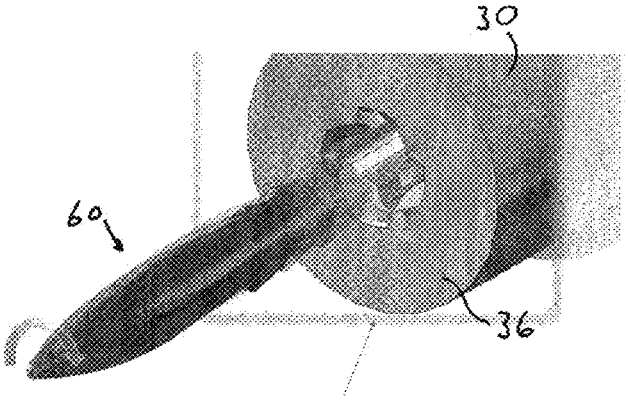

PROJECTILE AND FIREARM SYSTEM

CROSS-REFERENCE TO RELATED APPLICATIONS

The present application claims the benefit of U.S. provisional patent application 63/187,667 filed May 12, 2021 and entitled PROJECTILE AND FIREARM SYSTEM, the entirety of which is hereby expressly incorporated by reference.

BACKGROUND OF THE INVENTION

Field of the Invention

Generally, the present disclosure relates to firearms and cartridges for discharge with the firearm, and more particularly to cartridges having a projectile that includes a flight control surface, and more particularly to projectiles that do not require rotation about a longitudinal axis for external ballistic flight stability, and even more particularly to projectile that does not require a rifled barrel or a sabot to exhibit external ballistic flight stability.

Description of Related Art

Conventional projectiles, such as bullets, typically comprise a smooth uniform shank or body portion and an axially-symmetrical front or nose portion. Bullet performance is traditionally assessed with respect to parameters including velocity, ballistic coefficient (BC), trajectory, accuracy, and target penetration. Conventional bullets, after leaving the barrel and once under unpowered free-flight, substantially degrade in flight characteristics. For example, conventional bullets begin to wobble during flight, thereby losing accuracy and velocity. Upon striking a target, such reduced velocity and wobbling limits target penetration.

Current small arms ammunition development remains rooted to a basic set of core methodologies that permits only minimal incremental benefits inside a small window of available adjustment and advantages. The use of rifled barrels allows the projectile to be stabilized, but has material limitations due to the physical properties of the process. For example, a portion of the energy utilized to force the projectile out of the cartridge and down the barrel is lost as that energy leaves the barrel ahead of the projectile passing the object via the open space in the rifling grooves.

Various efforts have been made to improve spin stabilized projectile performance and/or enable additional projectile features. For example, U.S. Pat. No. 4,829,904 to Sullivan ("Sullivan") issued May 16, 1989, discloses a substantially full bore diameter bullet that has a plurality of elongated grooves either helically formed or parallel with the longitudinal axis of the bullet and a sabot, which has a body and fingers that engage with the grooves and seal the bullet in a casing. The sabot is configured with a slightly larger diameter than the bullet such that the sabot is engraved by the rifling slots in the barrel through which the round is fired, imparting a rotation to the bullet. In alternative embodiments the grooves contain elongated elements or a plurality of spherical elements to prevent the conically tapered slug or bullet from tilting or cocking in the barrel after firing. However, the use of sabots can negatively impact the external ballistics of the bullet as the sabot disengages from the bullet.

Therefore, the need remains for projectiles that do not require either rifling or sabots to provide repeatable and accurate external ballistic flight stability.

BRIEF SUMMARY OF THE DISCLOSURE

The present disclosure provides for a sabot-free projectile for passing through a bore of a barrel, the bore having a bore caliber, the projectile including an elongate body portion extending along a longitudinal axis, the elongate body portion having a transverse dimension configured to engage the bore; a tail portion defining a rear end of the projectile and including a plurality of radially extending tail fins, the radially extending tail fins having a leading edge longitudinally intermediate the elongate body portion and the rear end of the projectile; and a stem connecting the elongate body portion and the tail portion, wherein the stem has a stem diameter less than the body diameter; wherein the body portion, the tail portion, and the stem are colinearly disposed along a longitudinal axis and define a fixed integral assembly with a projectile center of pressure and a projectile center of mass, the projectile center of pressure being longitudinally intermediate the rear end of the projectile and the projectile center of mass; and wherein the rear end and at least a length of the tail portion includes a cavity extending along the longitudinal axis.

In a further configuration, a sabot-free projectile is provided for passing through a bore of a barrel, the bore having a bore caliber, the projectile including an elongate body portion having a body diameter and a first density, wherein the body diameter is a caliber diameter; a tail portion defining a rear end of the projectile and including a plurality of radially extending tail fins, the radially extending tail fins having a leading edge longitudinally intermediate the body portion and the rear end of the projectile; and a stem connecting the body portion and the tail portion, wherein the stem has a stem diameter less than the body diameter; wherein the body portion, the tail portion, and the stem are colinearly disposed along a longitudinal axis and define an integral assembly with a projectile center of pressure and a projectile center of mass, the projectile center of pressure being longitudinally intermediate the rear end of the projectile and the projectile center of mass; and wherein each tail fin includes at least two of a radial taper, a longitudinal taper, and a bottom surface.

Also disclosed is a sabot-free projectile for passing through a bore of a barrel, the bore having a bore caliber, the projectile including an elongate body portion having a plurality of radially projecting body portion fins, the body portion having a transverse dimension, wherein the transverse dimension is a bore caliber; a tail portion defining a rear end of the projectile and including a plurality of radially extending tail fins, the radially extending tail fins having a leading edge longitudinally intermediate the body portion and the rear end of the projectile; and a stem connecting the body portion and the tail portion, wherein the stem has a stem diameter less than the body diameter; and wherein the body portion, the tail portion, and the stem are colinearly disposed along a longitudinal axis and define an integral assembly with a projectile center of pressure and a projectile center of mass, the projectile center of pressure being longitudinally intermediate the rear end of the projectile and the projectile center of mass.

In one configuration, the present disclosure provides a sabot-free cartridge for a firearm, wherein the cartridge includes a casing; an elongate projectile extending along a longitudinal direction, the projectile coupled to the casing to define a charge volume; and a solid propellant retained within the charge volume; wherein the projectile includes at least one radially projecting and longitudinally extending flight control surface, such as but not limited to a fin or a vane, and wherein the flight control surface extends along at least 10%, to at least 50%, to at least 75% and in some configurations at least 90% of a length of the projectile. In one configuration, the fin is longitudinally bounded by longitudinally extending grooves, wherein a maximum radius from a center line of the projectile is defined by a radius of the fin. In a further configuration, a circumscribing circle of the projectile in a plane transverse to the longitudinal dimension of the projectile is defined by the radius of the fins.

The present disclosure further provides a projectile launcher for a cartridge having a projectile coupled to a casing, the projectile having a front end and a rear end with a longitudinal axis extending from the front end to the rear end and at least one radially projecting longitudinally extending flight control surface, wherein the projectile launcher includes a barrel having an elongate bore extending along the longitudinal axis, the elongate bore having a cross sectional profile configured to accommodate the radially projecting longitudinally extending flight control surface and form a gas check.

A magazine assembly is disclosed, wherein the magazine assembly includes a housing sized to retain a plurality of cartridges, each cartridge having a longitudinal axis and a projectile having a fin extending along the longitudinal axis, the housing having a presenting end and a distal end; a moveable follower disposed within the housing; and a bias member disposed intermediate the follower and the housing, the bias member configured to urge the follower towards the presenting end, wherein the follower includes a groove extending along the longitudinal axis of the cartridge, the groove sized to at least partly receive a portion of the fin of one of the plurality of cartridges. The magazine assembly is further configured to present the cartridge at the presenting end with the fin in a predetermined location.

In a further configuration, a projectile assembly for a firearm is disclosed, wherein the projectile assembly includes an elongate body having a leading surface and a trailing surface, the body including a passage extending from an upstream opening in the leading surface to a downstream opening in the trailing surface.

The disclosure further includes a cartridge having a casing, a projectile, the projectile having a radially projecting longitudinally extending flight control surface, and a cradle, wherein the cradle is disposed intermediate the projectile and the casing, and the cradle is configured to preclude passage along a barrel that is configured to guide the projectile.

BRIEF DESCRIPTION OF THE SEVERAL VIEWS OF THE DRAWING(S)

FIG. 1 is a perspective view of a first configuration of a projectile.

FIG. 2 is a side elevational view of the projectile of FIG. 1.

FIG. 3 is a cross sectional view taken along lines 3-3 of FIG. 2.

FIG. 4 is a side elevational view of the projectile of FIG. 1.

FIG. 5 is a front end view of the projectile of FIG. 4.

FIG. 6 is a rear end view of the projectile of FIG. 4.

FIG. 7 is a side elevational view of the projectile of FIG. 4, rotated about a longitudinal axis by 45°.

FIG. 8 is a front end view of the projectile of FIG. 7.

FIG. 9 is a rear end view of the projectile of FIG. 7.

FIG. 10 is a perspective view of a second configuration of a projectile.

FIG. 19 is a rendering of pressure distribution in external ballistics of the projectile of FIG. 10.

FIG. 20 is a representative barrel with a bore corresponding to the cross section of the projectile of FIG. 1.

FIG. 21 is a perspective view of a cartridge and alignment mechanism for a bore having a corresponding cross section.

FIG. 22 is a perspective view of a further configuration of the projectile.

FIG. 23 is a partial cross-sectional view of a cartridge having a first cradle and the projectile.

FIG. 24 is a partial cross-sectional view of a cartridge having a second cradle and the projectile.

FIG. 25 is a partial cross-sectional view of a cartridge having a third cradle and the projectile.

FIG. 26 is a front perspective view of a cradle.

FIG. 27 is a front end view of the cradle of FIG. 26.

FIG. 32 is a rear perspective view of the projectile and the cradle of FIG. 31.

FIG. 33 is a perspective view of the projectile and the cradle of FIG. 31 operably coupled to a casing.

FIG. 37 is a front end view of the projectile of FIG. 36.

FIG. 38 is a rear end view of the projectile of FIG. 36.

FIG. 39 is a side view of a further configuration of the projectile.

FIG. 40 is a front end view of the projectile of FIG. 39.

FIG. 41 is a cross sectional view of the projectile of FIG. 39.

FIG. 44 is a further embodiment of a cartridge with the present projectile.

FIG. 45 is a perspective view of a projectile at the muzzle of the barrel.

FIG. 46 is a perspective view of the projectile further passing the muzzle of the barrel of FIG. 45.

FIG. 47 is a perspective view of the projectile further passing the muzzle of the barrel of FIG. 45 showing the balancing of the propelling gases.

FIG. 48 is a perspective view of the projectile in external ballistics with an imparted longitudinal rotation from the propelling gases passing bore.

DETAILED DESCRIPTION

Figure 12:
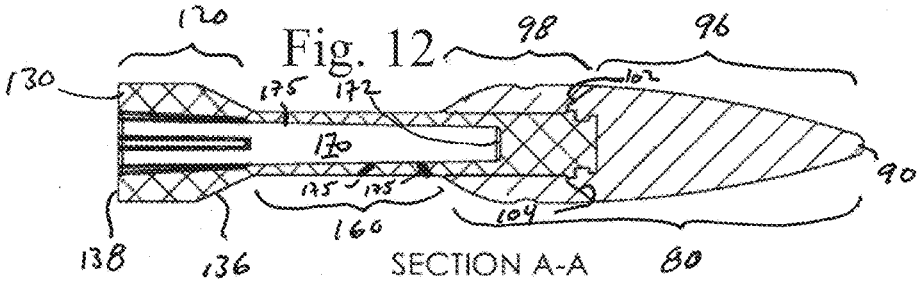
FIG. 12 is a cross sectional view taken along lines 12-12 of FIG. 11.
Figure 11:
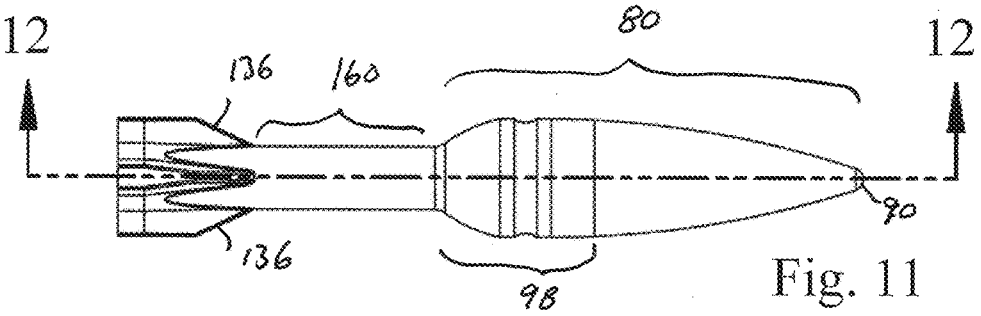
FIG. 11 is a side elevational view of the projectile of FIG. 10.
Figure 15:
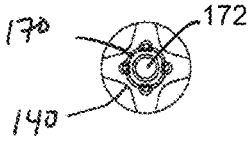
FIG. 15 is a rear end view of the projectile of FIG. 13.
Figure 13:
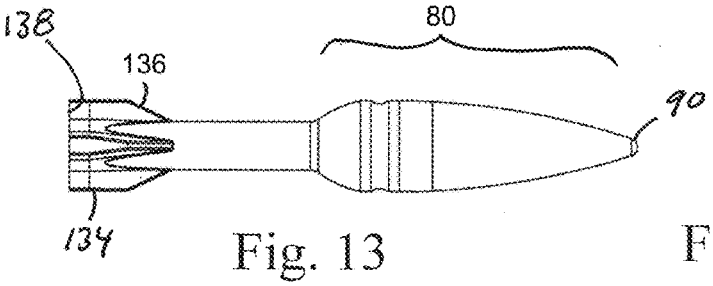
FIG. 13 is a side elevational view of the projectile of FIG. 10.
Figure 14:
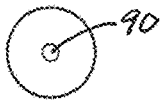
FIG. 14 is a front end view of the projectile of FIG. 13.
Figure 18:
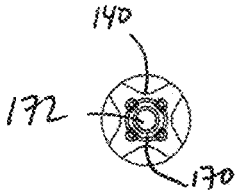
FIG. 18 is a rear end view of the projectile of FIG. 16.
Figure 16:
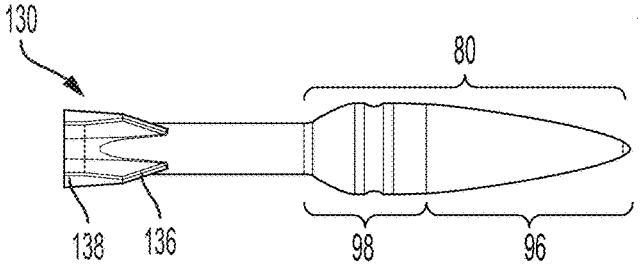
FIG. 16 is a side elevational view of the projectile of FIG. 13, rotated about a longitudinal axis by 45°.
Figure 17:
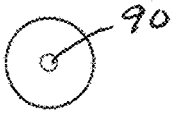
FIG. 17 is a front end view of the projectile of FIG. 16.
Figure 28:
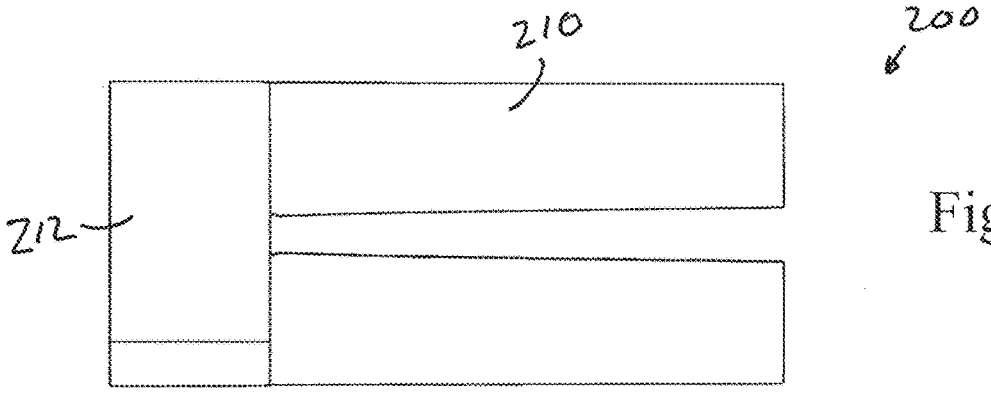
FIG. 28 is a side elevational view of the cradle of FIG. 26.
Figure 29:
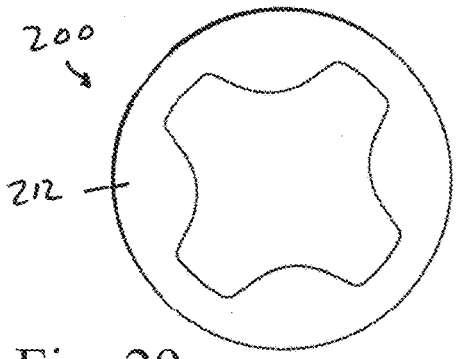
FIG. 29 is a rear end view of the cradle of FIG. 26.
Figure 30:
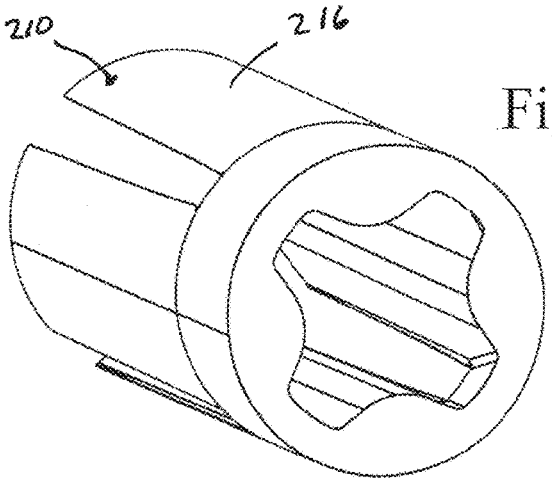
FIG. 30 is a rear perspective view of the cradle of FIG. 26.
Figure 31:
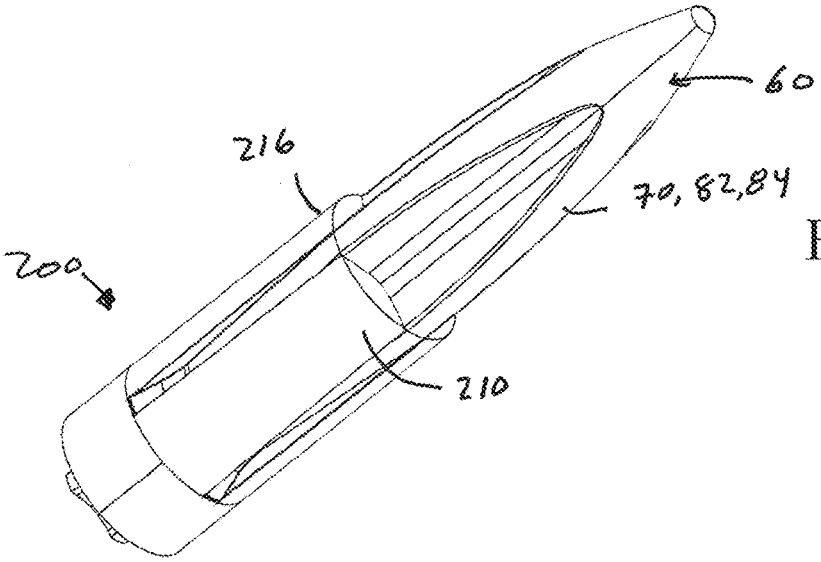
FIG. 31 is a perspective view of a projectile and a cradle.
Figure 34:
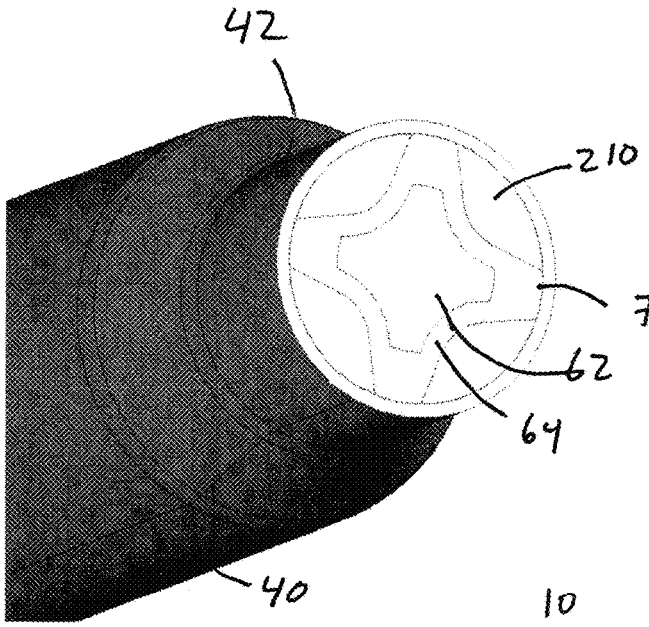
FIG. 34 is a cross sectional view of the projectile and cradle operably coupled to the casing.
Figure 35:
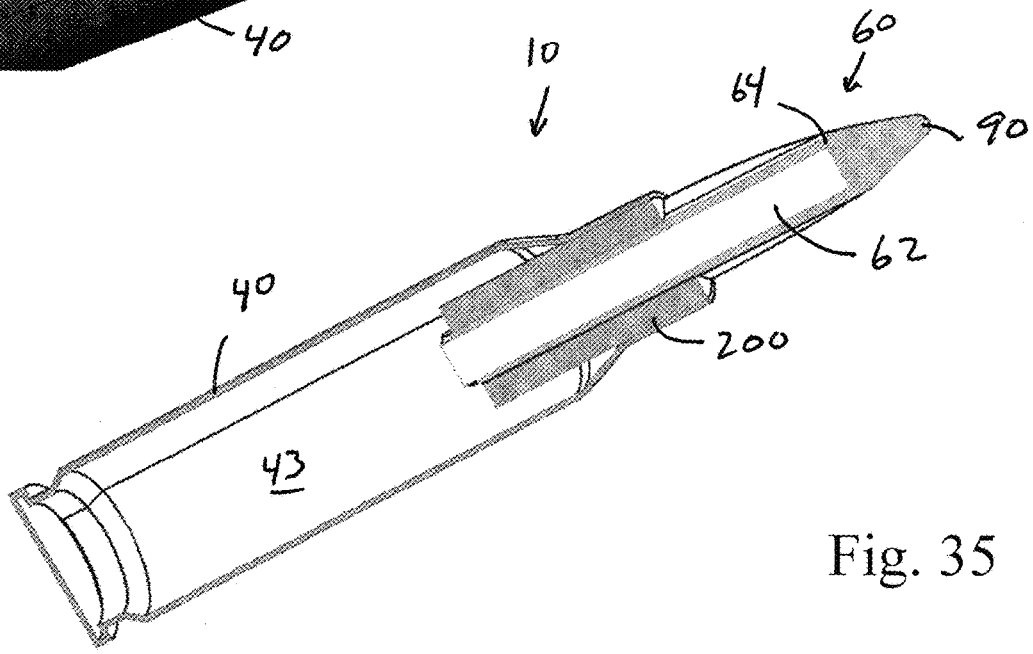
FIG. 35 is a cross sectional perspective view of a cartridge having the projectile, the cradle and the casing.

The present disclosure provides a cartridge 10 having a casing 40 and a projectile 60, wherein the cartridge cooperates with a firearm to launch the projectile through a barrel 30 of the firearm.

For purposes of the present disclosure, the term "firearm" includes an assembly of the barrel 30 and an action fixed to a stock (not shown) from which a projectile 60 is discharged such as by means of a rapidly burning propellant or combustion. The firearm is sometimes referred to as a small arm, weapon, gun, handgun, long gun, pistol, individual-service (i.e. for carry and operation by individual infantrymen), or revolver. The firearm can include the barrel 30 and a receiver (not shown). The receiver is the part of the firearm which integrates other components by providing a housing for internal action components such as the hammer, bolt or breechblock, firing pin and extractor. The receiver typically includes threaded interfaces for externally attaching ("receiving") components such as the barrel, the stock, the trigger mechanism and sights, including but not limited to iron/optical sights. The receiver is historically made of forged, machined, or stamped steel or aluminum. However, recent developments include receivers formed of polymers as well as sintered metal powders, such as through additive manufacturing.

The term "cartridge" 10 includes a unit of ammunition, generally including a casing (sometimes called a cartridge case), primer, powder, and the projectile 60. It is understood that the cartridge 10 is sometimes referred to a "round" or "load".

The term "projectile" 60 includes the object that is propelled by the force of gases, such as those produced by the rapidly burning propellant or combustion. For purpose of this disclosure, a bullet is a type of projectile 60.

The term "casing" 40 includes the envelope (container) of the cartridge 10, and is usually a metal cylindrical tube, normally made of brass but sometimes of steel or polymer. The casing 40 holds the projectile at a neck 42 of the casing, a propellant charge 44 is disposed within the casing, and a primer 46 is disposed in a base of the casing. The outer circumference of the base of the casing typically includes a circumferential recess and a corresponding rim to assist in extraction from the firearm after firing.

The term "barrel" 30 includes the elongate tube, extending along a longitudinal axis, through which the projectile is fired or launched. The barrel 30 includes a bore 33 having a caliber accommodating the projectile 60 to be fired, as known in the art, and terminates at a muzzle 36.

In prior systems, the barrel may include rifling having lands and grooves, wherein the lands are raised portions between the grooves inside the barrel after the spiral grooves are cut to produce the rifling. That is, the rifling includes a helical surface for contacting the projectile 60. In one configuration of the present disclosure, the barrel 30 includes straight cut rifling. That is, the present barrel 30 can include lands 32 and grooves 34, such as configured as guides for the flight control surface of the projectile, wherein the lands and grooves are parallel to the longitudinal axis of the barrel. There are additional configurations of the present disclosure that can incorporate traditional rifling, with either a left twist or a right twist.

For purposes of description, the term "fin" is used as a representative flight control surface and encompasses the term flight control surface. The flight control surface is any radially projecting and longitudinally extending surface of the projectile 60 that contributes to flight dynamics in at least one of the internal or external ballistics of the projectile.

Referring to FIGS. 1-9, a first configuration of the projectile 60 is shown. Generally, the projectile 60 includes an elongate body portion 80, a tail portion 120 including a plurality of radially extending tail fins 130 and defining a rear end 124 of the projectile, and a stem 160 connecting the body portion and the tail portion, wherein the stem has a stem diameter less than a maximum diameter of the body portion. In one configuration, the projectile 60 is an integral assembly, in that the projectile does not assume different profiles during external ballistics, or internal ballistics (other than propulsion induced temporary deformation). That is, in the integral assembly, the elongate body portion 80 is fixed relative to the stem 160 which has a fixed length, which in turn is fixed relative to the tail portion 120.

In the configuration of FIGS. 1-9, the body portion 80 includes a plurality of radially extending body portion fins 82. The body portion fins 82 can be formed as extending radially from the body portion 80 of the projectile 60. Alternatively, the body portion fins 82 can be formed by longitudinally extending recesses or grooves in the body portion 80 of the projectile 60. The body portion fins 82 are generally defined by a maximum diameter of the caliber of the bore 33, and can form a gas check with the surface of the groove 34 in the bore, wherein the bore includes a cross sectional profile configured to accommodate the fins, such as the radially extending body portion fins (flight control surfaces) 82. The body portion fins 82 can define a maximum dimension of the body portion 80 and/or the projectile 60 transverse to the longitudinal axis, that is a transverse dimension. For those configurations of the body portion 80 having a circular or curvilinear cross section, the maximum transverse dimension can be a diameter, and for those configurations of the body portion having a faceted cross section, the maximum transverse dimension may be a diagonal as defined by the faceted periphery.

It is contemplated the number of body portion fins 82 can include 2, 3, 4, 5, 6, 7, or 8 fins about the circumference of the body portion 80. However, it is understood there can be a single fin 82 or more than 8 body portion fins.

The body portion fins 82 are nominally uniformly distributed about the circumference of the projectile 60. However, it is recognized the body portion fins 82 can be asymmetrically located about the circumference as well as grouped, wherein the groupings of body portion fins are symmetrically located about the circumference of the body portion 80.

Figure 36:
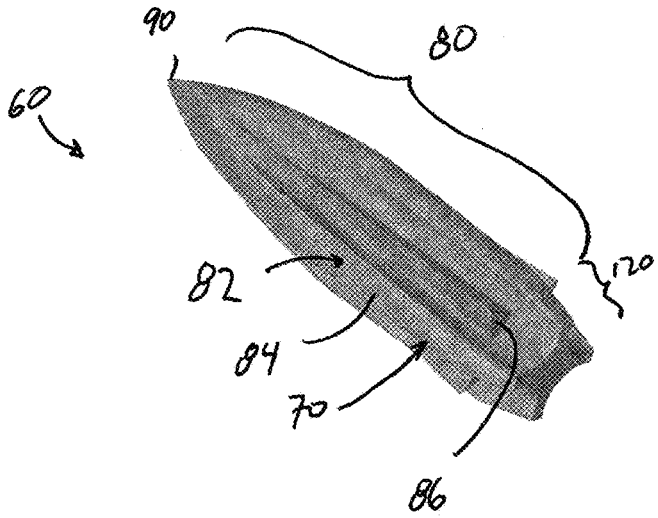
FIG. 36 is a perspective view of a further embodiment of the projectile.

As seen in FIGS. 36-38, the body portion fins 82 can include primary and secondary body portion fins 84, 86, wherein a primary body portion fin defines a maximum cross section dimension of the projectile and the secondary body portion fin has a shorter radial dimension. In those configurations of the projectile having both primary and secondary body portion fins 84, 86, the secondary fins may be longer than, shorter than, or extend the same longitudinal dimension as the primary fins. There may be more secondary body portion fins 86 than body portion primary fins 84, less secondary fins than primary fins or equal number of secondary fins and primary fins.

While the configurations shown include the primary body portion fins 84 being primary for the length of the fin, it is contemplated that a given body portion fin may have part of its length as a primary body portion fin and a second part of its length as a secondary body portion fin 86.

As seen in FIGS. 1-9, the body portion fins 82 extend along at least 25% of the length of the body portion 80 and in further configurations at least 50% of the length of the body portion and in further configurations at least 75% of the length of the body portion and in further configurations at least 85% of the length of the body portion and in further configurations at least 95% to 100% of the length of the body portion.

The body portion fins 82 can have a radial dimension from 5% to 75% of the diameter of the body portion. The body portion fins 82 can include a taper along a radial direction from a root to a tip 88. In one configuration, the tip 88 of the body portion fins 82 is generally curvilinear, consistent with continuous surfaced body portion, as well as the curvature of the bore 33. Though it is understood, the tip 88 can be an apex, wherein the bore 33 includes a corresponding apex. The circumferential dimension of the tips can range between 5% to 75% of the circumference of the body portion 80. In terms of the firearm 20, the firearm can thus provide a projectile launcher assembly having the barrel 30 defining the elongate bore 33 extending along the longitudinal axis, wherein the elongate bore has the cross sectional profile configured to accommodate the radially extending flight control surface 82 of the projectile 60 and form the gas check between the projectile and the barrel.

The body portion fins 82 can be tapered along the longitudinal direction thus having an increasing circumferential dimension as the fin extends along the longitudinal dimension from a front end 90 of the body portion 80 to a rear 92 of the body portion.

The body portion fins 82 are configured to stabilize the projectile 60 in flight in the absence of rotation about the longitudinal axis of the projectile. That is, the barrel 30 and the projectile 60 are not traditionally rifled. The body portion fins 82 provide flight stabilization without requiring a rotation of the projectile 60 about the longitudinal axis.

As seen in FIGS. 20 and 45-47, the barrel 30 can include a cross sectional profile configured to accommodate a radially extending fin (or flight control surface) of the projectile 60 so as to form a gas check with a portion of the fins. Thus, the barrel 30 can include a plurality of radially extending grooves 34 which extend beyond the caliber of the bore 33, wherein the grooves are formed along the entire length for the bore. The grooves 34 are sized to slideably receive the corresponding fins of the projectile 60, including fins on the body portion 80 of the projectile as well as tail fins on the tail portion of the projectile. Further, the grooves 34 are sized to substantially preclude shaping or deformation of the projectile 60, including the flight control surfaces 70, 82, 84, 86 during passage along the bore 33.

In an alternative configuration, the body portion of the projectile has a continuous surface, with a circumferential recess 99, such as shown in FIGS. 10-19 and defines at least one circumferential bearing surface 94 with the bore, to provide the gas check. In both this configuration of the body portion 80 and the configuration of FIGS. 1-9, the body portion can include a nose section 96 including the front end (tip) 90 and a back section 98 which includes the bearing surface 94 with the bore and transitions to the stem 160. The shape of nose section 96 is typically an ogive, which reduces the coefficient of drag of the projectile 10 and increases the ballistic coefficient.

In the configurations of FIGS. 10-19, the body portion 80 includes bearing surface 94 is a primary bearing surface and the body portion includes a secondary bearing surface longitudinally bounding the circumferential recess. The primary bearing surface 94 is rearward of the circumferential recess 99 and the secondary bearing surface 95 is forward of the circumferential recess. The bearing surfaces 94, 95 cooperate with a smooth bore barrel 30 and the primary bearing surface forms the gas check. It is contemplated the secondary bearing surface 95 can also restrict the passage of propulsion gases between the projectile 60 and the bore 33. The primary and secondary bearing surfaces being longitudinally spaced along the longitudinal axis can further provide stability (orientation maintenance) as the projectile 60 travels through the bore 33.

The nose section 96 and the back section 98 of the body portion 80 can be formed of different materials, having different densities and hardness. For example in one configuration, the nose section 96 has a greater density and is harder than the back section 98. For example, the nose section 96 can be formed of tungsten and the back section 98 formed of copper, or the core 62 as set forth below can be formed of lead. However, other material choices are available with departing from the present disclosure and preserving the relative hardness and density between the nose section 96 and the back section 98. In one configuration, the material of the nose section 96 and the shape of the section is selected to have a greater resistance to deformation than the stem 160 and the tail portion 120. A further benefit of tungsten, or a relatively hard front end 90, is a reduction in unintended deformation of the front end from incidental contact of the cartridge between manufacture and use. That is, nicks and mars on the front end 90 can negatively impact the performance of the given projectile 60, as well as decrease the consistency in round-over-round performance.

For example, representative materials of the nose section 96 and the back section 98 include:

| Material | Density |
|---|---|
| Tungsten | 19000 kg/m$^3$ |
| Copper | 8900 kg/m$^3$ |

The tail portion 120 of the projectile 120 defines the rear end 124 of the projectile 60 and includes the plurality of radially extending tail fins 130. As seen in FIGS. 1-19, the tail fins 130 are longitudinally spaced from the body portion 80 by the stem 160 of the projectile 60. The tail fins 130 radially extend from a root 132 to a tip 134 to define a span (the length of the fin projecting transverse to the longitudinal axis). The tail fins 130 have a leading edge 136, a sweep length, and a tip cord length. The leading edge 136 is the front surface of the fin 130. The sweep length is the longitudinal distance between the fin at the root and the tip. The tip chord length is the dimension of the tip along the longitudinal axis. In one configuration, the leading edge 136 of the tail fins 130 at the root is longitudinally spaced from the body portion 80 by a length along the stem 160 (a length along the longitudinal axis) that is at least a root chord length of the fins. That is, the stem 160 can have a greater longitudinal dimension than a root chord of the tail fins 130. The adjacent tail fins 130 can also define a bottom surface 140 which generally presents a projected area that is transverse to the longitudinal axis. The bottom surface 140 can be configured as a circumferential extension of the root 132 of one tail fin 130 towards the root of an adjacent tail fin, or as an increase in diameter along the longitudinal axis towards the rear end of either the body of the tail portion 120 (or the stem 160). In one configuration of the bottom surface 140, the bottom surface defines a slope with respect to the longitudinal axis of at least 10°, and in further configurations at least 20°, and in certain configurations at least 30° to 45° or more. Thus, the radial taper, the longitudinal taper, and the bottom surface can be configured to increase a pressure acting on the surfaces. While it is contemplated the tail fins 130 can include each of the radial taper, the longitudinal taper, and the bottom surface, there are configurations of the tail fins employing just one of the radial taper, the longitudinal taper, and the bottom surface, or employing at least two of the radial taper, the longitudinal taper, and the bottom surface. In one configuration, each tail fin 130 includes at least one of, at least two of, or each of a radial taper, a longitudinal taper, and the bottom surface 140. In a further configuration, the cumulative projected area of the tail fins 130 is between 20% of the cross sectional area of the stem and 2,000% of the cross sectional area of the stem 160, wherein the cross sectional area of the stem is taken as including the cross sectional area encompassed by the circumference of the stem. That is, a hollow stem is treated as a solid stem in calculating the cross sectional area.

In a further configuration, the span of the tail fins 130 is at least 10% of the caliber of the bore 33. In one configuration, each tail fin 130 has a span between 10% and 75% of the bore caliber. In another configuration, the span of the tail fin 130 is at least 25% the diameter of the stem. It is contemplated the tail fins 130 can be effectively defined by grooves formed in the stem 160, or the body of the tail portion 120, thus the tail fin could be defined by a negative diameter of the tail portion, or even the stem 160. Therefore, the span of the tail fin 130 can be between −50% to 600% of the diameter of the stem 160, or a cylindrical length of the tail portion 120.

As seen in the FIGS. 1, 2, 4, 7, 10, 12, 15, 16, and 19, the tail fins 130 can include a radial taper from the root 132 to the tip 134, wherein the root has a larger circumferential dimension than the leading edge 136 or the tip. The radial taper from the root 132 to the tip 134 can be from between 1.1:1 to 5:1. In addition, the tail fins 130 can have a longitudinal taper, wherein the leading edge 136 of the tail fins has a smaller circumferential dimension than a trialing edge 138 of the tail fins. The longitudinal taper from the leading edge 136 of the tail fin 130 to the trailing edge 138 of the tail fin can be from between 1:1.1 to 1:6. By adjusting the surface area of the leading edge 136 (either by adjusting the area of individual leading edges and/or number of leading edges) along with adjusting the radial taper and the longitudinal taper, the tail fins 130 can generate sufficient pressure (and hence force) during external ballistics (flight) of the projectile 60 to generate the center of pressure of the projectile rearward of the center of mass of the projectile, wherein the center of mass of the projectile can be adjusted by the materials (density) of the components of the tail portion 120, the body portion 80, and the stem 160 as well as the relative sizing of the nose section 96 and the back section 98 in the body portion.

In one configuration, the tail portion 120, including the tail fins 130 generate sufficient pressure on the projectile 60 so that the center of pressure of the projectile and the center of mass of the projectile create at least a 10% stability margin, where the stability margin is defined as (Center of $Mass_x$-Center of $Pressure_x$)/(Overall projectile length)*100, and is dependent on the angle of attack, velocity, etc. In certain configurations, the stability margin is between 0% and 45%. The present calculations are done at a 5° angle of attack. In certain configurations, it is believed the stability margin can increase as the angle of attack decreases from 5° towards 0°.

Although the tail fins 130 are shown as extending along the longitudinal direction between 15% to 20% of the total length of the projectile 60, it is understood the tail fins can extend along the longitudinal dimension from 0% to 60% of the total length of the projectile. In one configuration, the number of body portion fins 82 equals the number of tail fins 130, and in a further configuration, the body portion fins are longitudinally aligned with the tail fins, as seen in FIGS. 1-9. However, it is understood that the body portion fins 82 and the tail fins 130 can be longitudinally offset. It is further understood that the number of body portion fins 82 and the number of tail fins 130 can be unequal, wherein the number of tails fins is greater than or less than the number of body portion fins. It is further contemplated that the stem 160 can include longitudinally reinforcing ribs which project from an outer surface of the stem, wherein the reinforcing ribs are collinear with one or both of the body portion fins 82 and the tail fins 130. However, the reinforcing ribs do not materially contribute to the location of the center of pressure of the projectile 60.

In one configuration, the tail fins 130 can have a span to render the tail fins subcaliber. In a further configuration, the tail fins 130 can be sized to be adjacent the wall of the bore 33, thereby provide in a guiding function. It is further contemplated the radial dimension of the tail fins 130 can be selected to dispose the tip 134 of the tail fins within longitudinal grooves 34 of the barrel 30. In the sizing of the tail fins 130 to locate a portion of the tail fin within the grooves 34 of the barrel 30, the tip 134 of the tail fins can be gapped from contact of the tip with the bore, thereby providing incidental guidance, without imparting material drag. Alternatively, the tail fins 130 can be sized to ride along the bore, thereby providing longitudinal stability during the internal ballistics of the projectile 60.

In the configuration of the body portion 80 having the body portion fins 82 (as seen in FIGS. 1-9) and the configuration of the body portion having the circumferential recess 99 with the bearing surface 94 (as seen in FIGS. 10-19), the nose section 96 and the back section 98 can be formed of different materials. The nose section 96 and the back section 98 interface at a rear face 102 of the nose section and a front face 104 of the back section. It is contemplated the rear face 102 of the nose section 96 is not perpendicular to the longitudinal axis, and the front face 104 of the back section 98 has a correspondingly incline relative to the longitudinal axis. As set forth below, upon impact of the projectile 60 with the target, the momentum of the back section 98 and the incline of the interface causes the material of the back section to separate from the remainder of the projectile and transfer its energy to the target.

In addition to the nose section 96 and the back section 98 of the body portion 80 being formed of different materials, the stem 160 and the tail portion 120 can also be formed of separate materials. As set forth below in the manufacture of the projectile 60, the portions of the projectile can be separately formed and assembled to form the projectile.

The stem 160 connects the tail portion 120 to the body portion 80. As seen in FIGS. 1-19, the stem 160 has a subcaliber diameter. Depending on the strength of the material of the stem 160 and the intended operating parameters of the cartridge 10, the stem may have a diameter between 20% and 90% of the diameter of the body portion 80 or the bore 33 caliber. Although the stem 160 is shown having a substantially constant diameter, it is contemplated the diameter of the stem can vary along the longitudinal axis. By reducing the diameter of the stem 160 and selection of a relatively low density material (less dense than the body portion), the present design maintains the center of mass of the projectile 60 within the body portion 80. It is contemplated the stem 160 and/or the tail portion 120 can be formed of polymers, ceramics, aluminum, austenitic nickel-chromium-based superalloys, such as Inconel® by Special Metals Corporation, or other material known in the art.

The stem 160 can extend from approximately 15% to approximately 40% of the length of the projectile 60. As seen in the FIGS. 1-19, the stem has a length between 15% and 22% of the length of the projectile. The combined length of the stem 160 and the tail portion 120 can be less than the length of the body portion 80. In certain configurations, the combined length of the stem 160 and the tail portion 120 can be equal to or less than the length of the body portion 80.

In one configuration, the tail portion 120 and the stem 160 are formed of the same material. However, it is understood the tail portion 120 (and tail fins 130) can be a different material than the stem 160, which in turn is a different material (or at least different density) than the body portion 80.

Referring to FIGS. 3, 6, 9, 12, 15 and 18, the projectile 60 can include a cavity 170 extending from the rear end 124 of the projectile through the tail portion 120, the stem 160 and into the body portion 80. The cavity 170 includes a closed end 172, wherein in one configuration the closed end of the cavity is longitudinally within the back section 98 of the body portion. The cross sectional area of the cavity 170 at the rear end 124 of the projectile 60 can be between 25% to 90% of the cross sectional area of the rear end. In one configuration, the cavity 170 has a cross sectional that is greater than a remaining cross sectional area of the rear end 124 of the projectile 60. Referring to FIGS. 6, 9, 11, 12, the propulsive gases acting on the projectile 60 to launch the projectile act along the longitudinal axis on all the surfaces perpendicular to the longitudinal axis. Thus, the spaces between the tail fins 130 expose the rear surface of the body portion 80 to be exposed to propulsion gases. The present design exposes the closed end 172 of the cavity 170 and the rear of the body portion 80 to the majority of the propulsive gases. That is, as force is pressure times area, the present design generates the most force on the body portion 80 of the projectile 60, rather than the tail portion 120. Since the body portion 80 of the projectile 60 is formed of relatively rigid materials that can withstand the pressures generated with the internal ballistics, the action of the propulsion gases on the body portion reduces the forces on the stem 160 and the tail portion 120 that must be accommodated by rigid, and hence heavy materials. Further, the cavity effectively reduces the mass of the stem 160 and the tail portion 120, thereby providing that the center of mass of the projectile 60 can be further dominated by the body portion 80 and hence located further forward along the longitudinal axis.

In one configuration of the cavity 170, it is contemplated that a plurality of radial passages 175 can be formed fluidly connecting the cavity an external surface of the projectile 60 along the longitudinal axis. The radial passages 175 are configured to equalize pressure between the cavity and the exterior of the projectile 60, and particularly during internal ballistics. In one configuration, the radial passages 175 are believed to reduce pressure-induced deformation of the stem 160 and the tail portion 120 during the internal ballistics.

A further configuration of the projectile 60 is contemplated, where the cavity 170 extends from an open end the front of the projectile towards the rear end 124 to the closed end 172. In a further configuration, the cavity 170 can be longitudinally bounded so as to be located entirely within the projectile 60 thereby defining a chamber that is not exposed to an external environment.

Although FIGS. 1-19 show the projectile 60 including both the tail portion 120 and the stem 160, it is contemplated that the tail portion and the tail fins 130 can extend from the rear end 124 of the projectile to the body portion 80, thereby effectively subsuming the stem into the tail portion as seen in FIG. 22. That is, the tail fins 130 can extend from the rear end 124 of the projectile 60 to the body portion 80, wherein the fins include the leading edge 136 configured to deflect air during the external ballistics of the projectile.

Conversely, as seen in FIG. 36-43, the body portion 80 can generally extend to the rear of the projectile, wherein the body portion fins 82 extend along a majority of the length of the projectile. Thus, the body portion 80 can extend rearward to the tail portion 120, as seen in FIGS. 36-43, such that the body portion fins 82 may include lengths along the longitudinal axis having an increasing radial dimension, a length of decreasing radial dimension, wherein the tail fins then define an increasing radial dimension of the fins as the leading edge 136 of the tail fins 130, wherein the increasing radial dimension of the tail fins generate areas of pressure during external ballistics that are rearward of the center of mass of the projectile. Referring to FIGS. 36-43, the tail fins can be continuous with the body portion fins.

In each of the configurations, the flight control surfaces (fins) 70 of the projectile 60 are configured to provide aerodynamic stability at supersonic velocity of the projectile, without requiring or imparting rotation of the projectile or the use of sabots.

In select configurations of the cartridge 10, a portion of the radially projecting flight control surface, such as the tail fins 130 is at least partly disposed within the charge volume 43 within the casing.

For example, in the configuration of the projectile 60 in FIGS. 1-19, the tail fins 130 are located within the casing 40. In the configuration of the projectile having the body portion extending to the tail portion, at least the tail fins 130 are disposed within the casing.

As set forth above, the projectile 60 can include the front end 90 and the rear end 124 with the longitudinal axis extending from the front end to the rear end, and wherein the projectile is coupled to the casing 40 intermediate the front end and the rear end and the flight control surface 70 is located intermediate the coupling and the front end. The flight control surface 70 can be entirely disposed within the casing 40, entirely outside the casing or partly within the casing and partly outside the casing.

Figure 49:
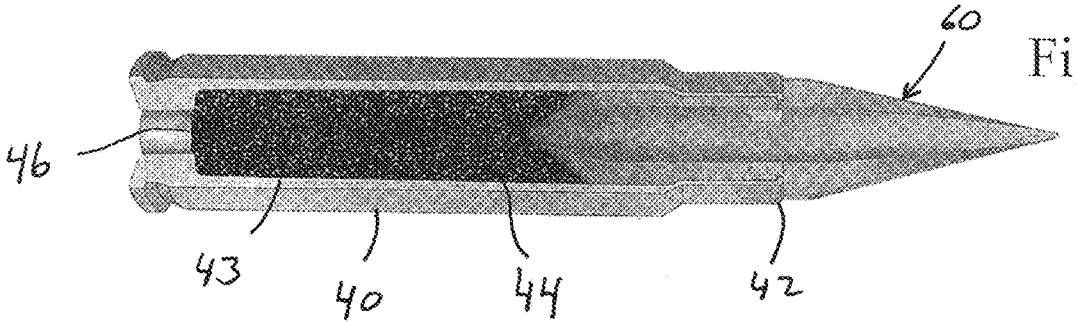
FIG. 49 is a cross sectional view of a further configuration of engagement of the projectile and the casing.

Referring to FIGS. 44 and 49, the casing 40 can include the neck 42 configured to form an interface with the projectile 60 and thus couple the projectile to the casing. Thus, the flight control surfaces 70 can extend between the front end 90 of the projectile and the neck 42, between the rear 124 of the projectile and the neck or across the neck. As seen in FIG. 44, the neck 42 may be formed to have a shape corresponding to the cross section of the projectile, thereby forming a tight seal between the casing 40 and the projectile when manufactured, such that the interface is weatherproof and establishes obturation in a like-shaped chamber upon firing of the cartridge.

In those configurations in which the longitudinally extending fins 82 extend longitudinally across the neck 42, the cartridge 10 can include a peripheral cladding or packing at the interface with the neck 42 of the casing, so that the neck of the casing engages the outermost radial surface of the fin and the cladding or packing to form a sealed interface. Alternatively, a filler can be affixed to the projectile adjacent the flight control surface, thereby forming a portion of an interface with the casing, and typically at the neck. The filler can be combustible or non-combustible. Alternatively, or in addition, the casing can include an accommodating surface for interfacing with the flight control surface.

In a further configuration, the casing 40 can be crimped or deformed about the projectile 60, wherein the casing is constructed and configured to enable sufficient local deformation to form a sealed interface about the flight control surfaces. For example in FIGS. 44 and 49, the casing 40 can be crimped to the projectile 60 either an additional segment(s) of brass or similar material to the interior casing wall, or by some process in which the face edge of the neck portion of the casing is rolled, crimped or folded to conform to the projectile.

In one configuration, the flight control surface 70 is integral to the projectile 60. However, it is contemplated the flight control surface 70 can be separable from the projectile 60, such as a frangible flight control surface. It is further contemplated the frangible flight control surface can be integral with the projectile, with the structure providing for the flight control surface to be frangible.

It is further contemplated that the flight control surface 70 can be moveable from a retracted position to an extended position as well as configurations in which the flight control surface generates lift.

Thus, the projectile 60 can include the body portion 80 connected to the radially projecting longitudinally extending flight control surface, or fin 82, wherein the body portion has a maximum body dimension transverse to the longitudinal dimension and the flight control surface, or fin, defines a maximum fin dimension transverse to the longitudinal dimension, wherein the maximum fin dimension is greater than the maximum body dimension. In select configurations, the maximum fin dimension is the caliber of the bore 33. It is further contemplated, the cartridge 10, and specifically the casing 40, can include external surface features, such as but not limited to ribs, or fins which are configured to align the cartridge and hence projectile 60 with the corresponding profile of the barrel bore 33, so as to properly dispose the projectile relative to the bore and form a gas check upon firing of the cartridge.

Depending on the specific configuration of the projectile 60, the present disclosure further contemplates a magazine assembly having a housing sized to retain a plurality of cartridges, each cartridge having a longitudinal axis, the housing having a presenting end and a distal end; a follower disposed within the housing; and a bias member disposed intermediate the follower and the housing, the bias member configured to urge the follower towards the presenting end, wherein the follower includes a groove extending along the longitudinal axis of the cartridge, the groove sized to at least partly receive a portion of a radially projecting flight control surface, casing surface feature, or fin, of one of the plurality of cartridges. The follower can be further configured to present the cartridge at the presenting end such that the flight control surface is within a predetermined location relative to the barrel.

In a further configuration of the projectile 60, the flight control surface 70 is defined by a passage or channel extending from an upstream opening in a leading surface of the projectile, such as in the body portion, to a downstream opening in a trailing surface of the body portion, the stem or the tail portion. The upstream opening can be radially spaced from the longitudinal axis by a greater distance than the downstream opening. However, it is further contemplated the downstream opening can be further radially spaced from the longitudinal axis than the upstream opening. Further, the downstream opening can be equally radially spaced from the central axis as the upstream opening.

The projectile 60 can be a homogeneous construction. That is, while the material of the projectile 60 made be a specific composition of a variety of different materials, the composition of the projectile is homogeneous throughout the projectile. The materials of the projectile 60 include any of a variety of commercially available materials used for projectiles.

Figure 42:
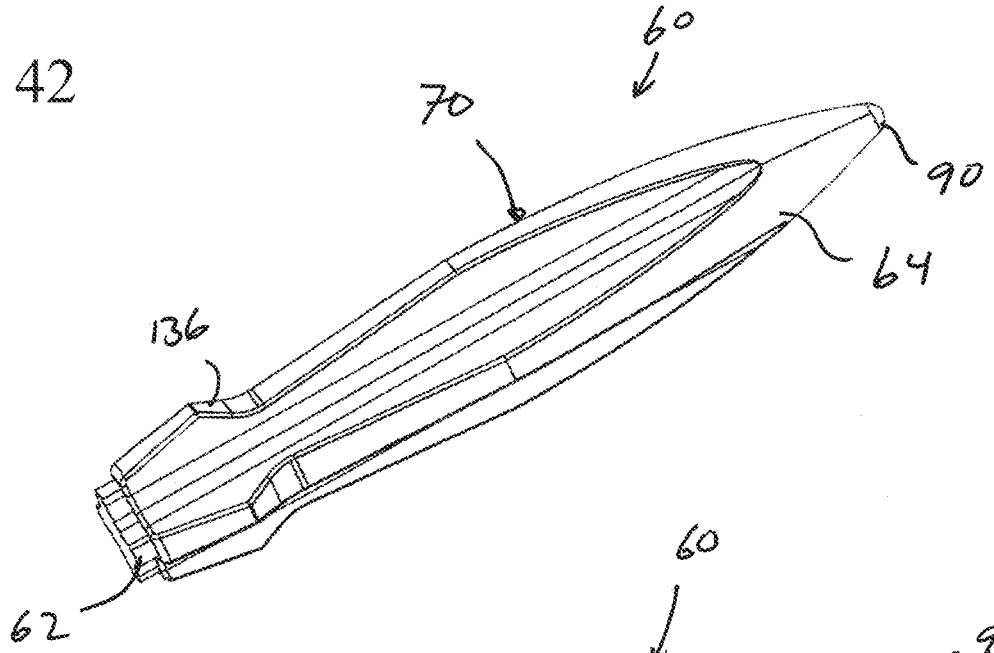
FIG. 42 is a perspective view of the projectile of FIG. 39.
Figure 43:
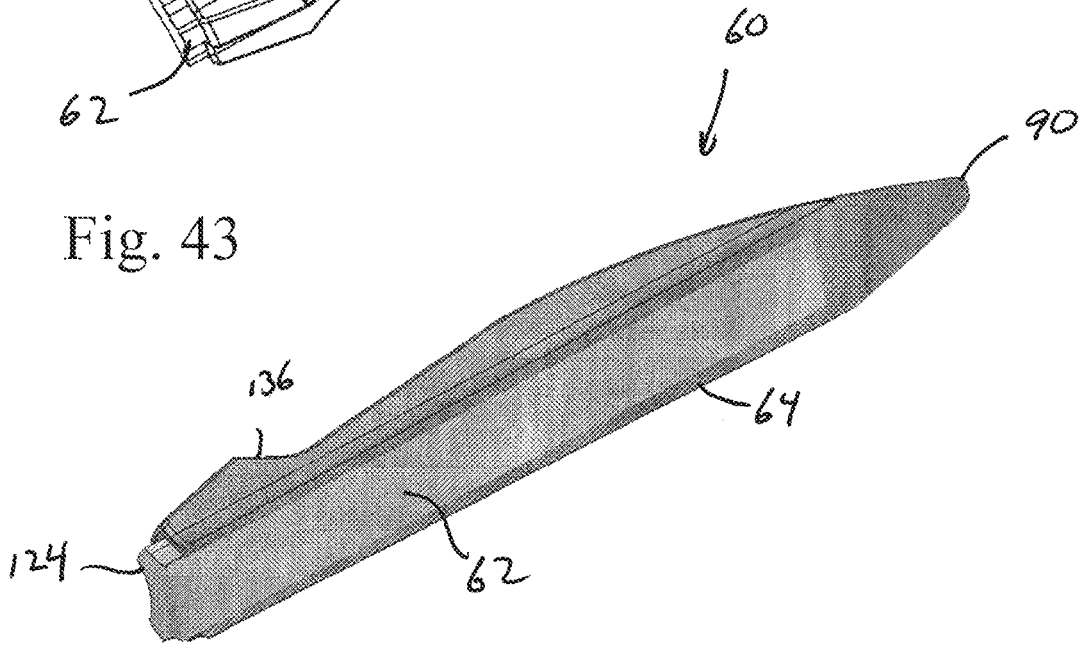
FIG. 43 is a cross sectional view of the projectile of FIG. 39 taken along the longitudinal axis.

In addition to the different portions of the projectile 60 being formed of different materials, as set forth above, it is contemplated that in one configuration, the projectile, or at least a portion of the projectile, such as the body portion 80, can include a core 62 having a cladding 64 extending over at least a portion of the core, as seen in FIGS. 41-43. It is contemplated the cladding 64 can encompass the core 62, or extend along a majority of the length of the core. It is anticipated the cladding 64 is symmetrically disposed about the core 62 about the longitudinal center line of the core.

With respect to cross sectional relation of the core 62 to the cladding 64, the majority of the cross-sectional area for a majority of the length of the projectile, or a portion of the projectile, such as the body portion, can be formed by the core. However, it is anticipated that terminal ends of the projectile 60 are formed entirely by one of the core 62 or the cladding 64. Thus, the core 62 can form a portion of the body portion fins 82, including the primary and the secondary fins 84, 86, wherein the cladding 64 forms the outer, or exposed, surface of the fins as well as the tail fins. Alternatively, the body portion 80 and/or tail fins 130 can be entirely formed of the cladding 64. That is, in the configuration of the core 62 having a cylindrical configuration, the cladding can define the radially projecting fins.

In one configuration, the core 62 has a greater density and is harder than the cladding 64. Typically, the core has a greater Brinell hardness than the Brinell hardness of the cladding. For example, the core 62 can be formed of tungsten and the cladding 64 formed of copper, or lead. However, other material choices are available with departing from the present disclosure and preserving the relative hardness and density between the core and the cladding. Additional available materials for at least portions of the projectile 60, such as the body portion 80, the stem 160, and/or the tail portion 120 include those as listed herein as well as aluminum, aluminum alloys, and elastomers, including thermosets and thermoplastics, including but not limited to nylon.

For example, representative materials of the core and cladding include:

| Material | Density |
|---|---|
| Tungsten | 19000 kg/m$^3$ |
| Copper | 8900 kg/m$^3$ |

In one configuration, the materials of the core 62 and the cladding 64 are selected to locate a center of mass of the projectile 60 in accordance with existing projectiles, so as to minimize retraining when employing the present cartridge. It is further contemplated the materials of the core 62 and the cladding 64 are selected and the core and cladding sized to locate a center of mass of the projectile towards the front of the projectile 60.

The ratio of the mass of the core 62 to the mass of the cladding 64 is at least 1:1 and in further configurations 1.2:1, and in further configurations the ratio can be 1.4:1 and in select configurations, 1.5:1 or more. It is contemplated that the composite structure of the projectile 60 may provide terminal advantages at longer distance impacts, as the cladding 64 can separate from the core 62 and thus distribute within the target without requiring adding impact energy.

In the configuration of the projectile 60 including the core 62 and the cladding 64, the cladding forms the outer surface of the projectile as the projectile is disposed in the cartridge 10. This configuration, the outer surface of the projectile can be free of fins, and is thus exhibits a length having a cylindrical profile extending along the longitudinal axis, with leading end 90 being tapered or ogive. The cylindrical profile forms the interface with the casing, such as at the neck 42 of the casing 40. In this construction, it is further understood the cylindrical profile can include different circumferences along the longitudinal dimension. In this configuration, the cladding 64 is formed of a relatively soft or malleable material and the barrel 30 includes shaping surfaces that impart radially projecting longitudinally extending (non-helical) flight control surfaces 70, such as fins, as the projectile 60 passes along the bore 33 of the barrel. In this configuration, the fins 70 may have a reduced radial dimension, such as less than 25% and in certain configurations, less than 10% and less than 5% of the diameter, or radius, of the projectile 60. Further, as set forth below, the barrel 30 or the muzzle brake can provide honing of the passing projectile 60. For example, the projectile 60 can be honed so as to true up the projectile, such as but not limited to with or without fins, or other surface features. It is anticipated in the composite configuration of the projectile 60, that the incorporation of lubricants or lubricious material will lengthen the operating life of the barrel 30. The formed flight control surfaces 70 are generated to impart external ballistic stability to the projectile 60.

The shaping surfaces of the barrel 30 can be used to impart the flight control surfaces 70. Alternatively, the muzzle brake can include the shaping surfaces, thereby locating these relatively high wear surfaces in a modular component of the barrel 30 that can be readily replaced. It is further contemplated the shaping surfaces can be located in both the barrel 30 and the muzzle brake, thereby at reducing the wear on surfaces of the barrel.

In current firearms, the barrel is rifled with a particular twist rate, i.e. 1 turn in 7 inches (1:7). The twist rate limits the performance of the firearm in that a projectile can only be rotated at a specific RPM (twist rate). Also, a drop in performance is regularly noted in conventional systems when a heavier or lighter bullet, confined to a specific twist rate, is rotated at an inappropriate RPM. The present disclosure contemplates the use (interchangeability) of a variety of muzzle brakes to impart corresponding different twist rates, thus allowing for the user to select an appropriate muzzle brake device dependent on the desired performance of the projectile. Thus, the end user can select a wider range of cartridges 10 that can be stabilized regardless of projectile (bullet) weight without compromising terminal performance. The detachable muzzle brake or muzzle device having rotation imparting surfaces can effectively convert a tradition barrel into a multi-platform variable projectile specific firearm 20. That is, a plurality of muzzle brakes can be provided, wherein each muzzle brake includes a specific twist rate and can be operably engaged/disengaged with the barrel to accommodate different weight projectiles, without having to switch barrels 30 or firearms 20.

Referring to FIGS. 23-36, in one configuration, the cartridge 10 includes a cradle 200 for at least partly forming the interface between the projectile 60 and the casing 40. As seen in the FIGS. 23-35, the cradle 200 includes a plurality of fingers 210 sized to be received between consecutive fins 70 of the projectile 60. The fingers 210 can be joined by a retaining ring 212, to form a single integral unit.

Depending on the configuration of the fins 70, 82, 84 or 86, the fingers 210 of the cradle 200 (in combination with the exposed radial portion of the fins) or the retaining ring 212 can define the interface with the casing 40. In either configuration, the combined cross section of the cradle 200 and the projectile 60 define the plug at the interface with the casing 40, thereby sealing the powder in the casing. The cradle 200 and the projectile 60 are configured to define a plug at the interface with the casing. The plug precludes, or at least inhibits the passage of propellant from the casing 40.

As seen in the FIGS. 23-25 and 31-35, the fingers 210 have an inner surface 214 configured to mate with the cross section of the projectile 60 as defined by adjacent fins 70, 82, 84, or 86. An outer surface 216 of the finger 210 defines a portion of a circular periphery sized to cooperatively engage a portion of the casing 40, such as the neck 42 of the casing.

In one configuration, the outer periphery of the fingers 212 and the exposed outer surface of the fins 70, 82, 84, or 86 define a substantially circular periphery which is engaged by the casing 40, such as the neck 42. However, it is understood the outer surface 216 of the fingers 210 can radially extend beyond an adjacent portion of the fins 70, 82, 84, or 86 and thus the cradle 200 can form the contact surface with the casing 40 as the adjacent portions of the fins are recessed for the exterior of the fingers. In this configuration, the plug is formed at a different longitudinal location of the cross section of the projectile 60 and the cradle 200.

In a further configuration of the cradle 200, the cradle is a sleeve that includes an internal passage having a cross section compatible with the cross section of the corresponding portion of the projectile 60. In this configuration, the cradle 200 forms the interface with the casing 40, independent of the fins 70, 82, 84, or 86. It is contemplated that the cradle 200 remains in the spent casing 40, having its seal broken at the casing neck 42 when the projectile 60 is released under pressure of ignited propellants during firing.

The barrel 30 of the corresponding firearm includes the longitudinally extending lands 32 or grooves (guide surfaces) 34 configured to slidably receive the fins 70, 82, 84, or 86 of the projectile 60. Thus, upon chambering the cartridge 10, the fins 70, 82, 84, or 86 of the projectile 60 are operatively aligned with the corresponding guide surfaces 34 extending longitudinally along the barrel 30.

Correspondingly, a lead end 218 of the fingers 210 of the cradle 200, or the retaining ring 212 of the cradle are thus aligned with the land areas 34 of the barrel 30 which preclude movement of the cradle along the longitudinal axis of the barrel.

Thus, upon firing of the cartridge 10, the propellant converts to gas which acts on the plug formed by the cross section of the projectile 60 and the cradle 200. Movement of the cradle 200 along the longitudinal direction from the expanding gas is at least partly blocked by the cradle, as the cradle abuts the shoulders of the lands 34 of the barrel 30, and the expanding gas propels the projectile 60 from the casing 40 and along the barrel. In one configuration, the guide surfaces (lands 34 and/or grooves 32) of the barrel 30 extend parallel to the longitudinal axis and are free of any twist or helical inclination.

Thus, the cradle 200 can be sized to limited movement in the longitudinal direction in response to firing of the propellant. That is, the cradle 200 can be configured to locate the front end of the cradle, such as the lead end 218 of the fingers 210 adjacent to the stop shoulders of the lands 34 of the barrel 30 upon operably locating the cartridge 10 in the chamber. However, it is further contemplated that the function of the cradle 200, such as the fingers, can be performed by extensions of the barrel grooves and/or lands into corresponding configuration of the casing 40 to provide additional guidance of the projectile 60 during firing as the projectile moves from the casing to and through the bore 33.

The cradle 200 can be formed of a variety of materials including polymers, such as but not limited to ultrahigh molecular weight polyethylene, UHMWPE.

As seen in the FIGS. 26 and 27, the inner surface 214 of the cradle 200 and particularly the inner surface of the fingers 212 can include a releasable lubricant or lubricious material to be distributed along a portion of the interface between the projectile 60 and the barrel 30. Dry lubricants can be deposited on the inner surface 214 of the cradle 200 so that as the projectile 60 moves relative to the cradle during firing, some of the dry lubricant is carried by the projectile and thus becoming operably located intermediate the projectile and the barrel 30. Available dry lubricants include graphite, talc, and molybdenum disulfide as well as hexagonal boron nitride (white graphite) and tungsten disulfide. It is anticipated the use of the dry lubricants will lengthen the operating life of the barrel life. In a further configuration, a select projectile 60 can include a lubricious and/or cleaning cladding or coating, configured to provide that upon firing a cartridge 10 having the coated projectile, the lubricant and/or cleaner is contacted with the bore. It is further contemplated that depending on the particular lubricious and/or cleaning material that the projectile 60 can be formed of, or include components formed of the lubricious and/or cleaning material, wherein such components distribute the material to the bore during the internal ballistics of such a cartridge 10.

It is understood that a portion of the gas resulting from the combustion of the propellant (such as the powder) may pass along the barrel 30 alongside or even ahead of the projectile 60. As seen in the FIGS. 45-47, the gas exiting from the muzzle 36 will act on both the muzzle and the projectile 60. It is theorized that by providing the relatively tangential surfaces as defined by the flight control surface 70, 82, 84, or 86, such as the transition from fin to groove, the expanding gas may act to stabilize the projectile 60 as it passes from the barrel 30, thus providing an intended trajectory of the projectile without imparting any rotation. The generated gas acting on the projectile 60 may be used to stabilize the projectile as the projectile exits the muzzle 36. That is, the gas can act on the relatively large surfaces of the flight control surfaces 70, 82, 84, or 86 that are transverse to the longitudinal axis of the barrel 30. Conversely, it is contemplated that a shaped portion of the barrel proximate to the muzzle 36 can impact the expanding gas with the projectile 60 to impart a spin of the projectile about the longitudinal axis of the projectile.

Alternatively, as seen in FIG. 48, the guide surfaces 32, 34 of the barrel 30 can be used to act on the flight control surface and impart a rotation to the projectile. Thus, the barrel 30 can be configured to impart the projectile stabilization or impart the rotation to the projectile.

Alternatively, the muzzle brake can be employed to impart the spin of the projectile 60 (either by guide surfaces in the muzzle brake or directing the impacting expanding gas) or to direct an expanding stabilizing gas pattern to impact the projectile 60 to stabilize the projectile as it leaves the muzzle 36. That is, the muzzle brake can include surfaces for contacting the flight control surface 70, 82, 84, or 86 to impart the rotation of the projectile 60. The guidance of the projectile 60 by guide surfaces wears the guide surfaces 32, 34 and causes a finite operable life of the guide surfaces, and thus barrel 30. However, by locating the guide surfaces in the muzzle brake, the wear can be borne by the readily replaceable muzzle brake rather than the more expensive barrel 30.

It is further contemplated, that to reduce barrel wear from rotation of the projectile 60 relative to the barrel 30, the barrel can be indexed or rotated to impart a rotation of the projectile. However, it is recognized that the energy required to move the mass of the barrel 30 or even a rotatable portion of the barrel may be detrimental to the otherwise available energy to the projectile 60.

Thus, the present disclosure provides the sabot free cartridge 10 for the firearm having the barrel 30 with the bore 33 having non-helical longitudinally extending guide surfaces, the cartridge including the casing 40, the projectile 60 coupled to the casing to define a charge volume, the projectile extending along a longitudinal direction; and the solid propellant retained within the charge volume; wherein the projectile includes the radially projecting flight control surface, the radially projecting flight control surface 70, 82, 84, or 86 extending longitudinally along at least 50% of a length of the projectile and sized to by slideably received in the non-helical longitudinally extending guide surface of the bore. It is further contemplated the flight control surface includes a plurality of radially projecting fins, and further wherein each of the plurality of radially projecting fins extends at least 25%, to at least 50%, to at least 75% and in some configurations at least 90% of a length of the projectile. In one configuration, a portion of the radially projecting flight control surface is at least partly disposed within the charge volume. The projectile 60 includes front end 90 and a rear end 124 with a longitudinal axis extending from the front end to the rear end, and wherein the projectile is coupled to the casing 40 intermediate the front end and the rear end and the flight control surface 70, 82, 84, or 86 is located intermediate the coupling and the front end. The casing of the cartridge can include a neck 42 configured to engage the projectile 60 with the casing 40 and the flight control surface 70, 82, 84, or 86 includes a plurality of symmetrical fins longitudinally intermediate the neck and the front end 90 of the projectile. Alternatively, the casing 40 includes the neck 42 configured to couple the projectile 60 to the casing 40 and the flight control surface 70, 82, 84, or 86 includes a plurality of symmetrical fins longitudinally intermediate the neck and the rear end 124 of the projectile. It is contemplated the flight control surface 70, 82, 84, or 86 is integral to the projectile 60. In a further configuration, the flight control surface 70, 82, 84, or 86 is separable from the projectile 60. The cartridge can include a filler affixed to the projectile 60 adjacent the flight control surface 70, 82, 84, or 86. In one configuration, the flight control surface 70, 82, 84, or 86 is moveable from a retracted to an extended position. It is contemplated that the flight control surface 70, 82, 84, or 86 can be configured to generate lift on the projectile 60. In addition, the casing 40 can include an accommodating surface 32, 34 for the flight control surface 70, 82, 84, or 86. Thus, in one configuration, the flight control surface is a groove in an exterior surface of the projectile 60. In the cartridge, the projectile 60 includes a central body 80 connected to the radially projecting flight control surface, the central body having a maximum body dimension transverse to the longitudinal dimension, and wherein the radially projecting flight control surface 70, 82, 84, or 86 defines a maximum fin dimension transverse to the longitudinal dimension, the maximum radial dimension of the flight control surface being greater than the maximum body dimension.

The present disclosure further contemplates a projectile launcher having the projectile 60 coupled to the casing 40, the projectile having a front end 90 and a rear end 124 with a longitudinal axis extending from the front end to the rear end and at least one radially extending flight control surface 70, 82, 84, or 86; and the barrel 30 having an elongate bore 33 extending along the longitudinal axis, the elongate bore having a cross sectional profile configured to accommodate the radially extending flight control surface and form a gas check, wherein the a cross sectional profile of the bore 33 is free of helical features contacting the projectile. With respect to the projectile launcher, the radially extending flight control surface 70, 82, 84, or 86 can be a fin having a leading edge 136.

As set forth above, the magazine assembly is provided having housing sized to retain a plurality of cartridges, each cartridge having a longitudinal axis, the housing having a presenting end and a distal end; a follower disposed within the housing; and a bias member disposed intermediate the follower and the housing, the bias member configured to urge the follower towards the presenting end, the follower including a groove extending along the longitudinal axis of the cartridge, the groove sized to at least partly receive a portion of a radially projecting flight control surface of one of the plurality of cartridges.

In addition, the projectile can be a composite projectile assembly including an elongate body having a longitudinal axis extending between a leading end and a trailing end, the elongate body including a plurality of fins 70, 82, 84, or 86 extending parallel to the longitudinal axis, wherein the elongate body includes a core 62 of a first material and a cladding 64 of a different second material. In one configuration, the cladding 64 forms the plurality of fins. It is contemplated the core 62 is denser than the cladding 64.

The present disclosure includes the cartridge 10 for launching the projectile 60 through the barrel 30 including the casing 40, the projectile coupled to the casing to define a charge volume, the projectile extending along a longitudinal direction; a solid propellant retained within the charge volume; and the cradle 200 extending about at least a portion of a periphery of the projectile, the cradle being radially intermediate the casing and the projectile and configured to preclude passage of the cradle through the barrel. In one configuration, the cradle 200 includes a plurality of fingers 212. The cradle 200 can be configured to inhibit separation from the casing 40.

Alternatively, the projectile launching assembly for launching the projectile 60 having longitudinally extending flight control surfaces 70, 82, 84, or 86 by an expanding gas, includes the barrel 30 having the elongate bore 33, the bore having a cross section to pass the projectile, wherein the bore includes gas directing surfaces configured to impact a portion of the expanding gas. In this configuration, the directing surfaces are configured to impart a rotation of the projectile 60 about the longitudinal axis. Alternatively, in this configuration, the directing surfaces are configured to stabilize a trajectory of the projectile 60 about the longitudinal axis.

The projectile launcher kit can include the receiver; the barrel 30 connected to the receiver, the barrel having an elongate bore 33 extending along the longitudinal axis; and the plurality of muzzle brakes, each muzzle brake configured to operably couple with the barrel, the plurality of muzzle brakes including a first muzzle brake having a first twist rate and a second muzzle brake having a different second twist rate. In this kit, the cartridge 10 includes the casing 40 and the projectile 60 coupled to the casing, the projectile having the front end 90 and the rear end 124 with a longitudinal axis extending from the front end to the rear end and a radially projecting longitudinally extending flight control surface 70, 82, 84, or 86. The elongate bore has a cross sectional profile configured to accommodate the radially projecting longitudinally extending flight control surface 70, 82, 84, or 86 and form a gas check.

It is believed a cartridge 10 employing the projectile 60 requires less propellant (powder) than prior art projectiles, while still providing the same stopping capacity or range. This allows the cartridges 10 employing the present projectiles 60 to be lighter, thereby improving economics of manufacture as well as transportation of the cartridges 10. For example, in the configuration of the body portion 80 having the body portion fins 82, the amount of material used to the form such body portion is less than the body portion having the circumferential recess 99.

It is further contemplated that the tail portion 120 can be replaced by an extended length of the stem 160, wherein the extended length of the stem is sufficient to generate a stability margin sufficient to impart external ballistic stability. In one configuration, the extended stem can be an elongate flexible member which can be disposed between a retracted (or coiled) state and an extended (or uncoiled) state.

This disclosure has been described in detail with particular reference to an embodiment, but it will be understood that variations and modifications can be effected within the spirit and scope of the disclosure. The presently disclosed embodiments are therefore considered in all respects to be illustrative and not restrictive. The scope of the invention is indicated by the appended claims, and all changes that come within the meaning and range of equivalents thereof are intended to be embraced therein

The invention claimed is:

1. A cartridge for a firearm, the cartridge comprising:

(a) a projectile having (i) a body portion extending along a longitudinal axis, the elongate body portion having a transverse dimension configured to engage the bore;

(ii) a tail portion defining a rear end of the projectile and including a plurality of radially extending tail fins, the radially extending tail fins having a leading edge longitudinally intermediate the elongate body portion and the rear end of the projectile; and (iii) a stem connecting the elongate body portion and the tail portion, wherein the stem has a stem diameter less than the transverse dimension;

wherein the body portion, the tail portion, and the stem are colinearly disposed along a longitudinal axis and define a fixed integral assembly with a projectile center of pressure and a projectile center of mass, the projectile center of pressure being longitudinally intermediate the rear end of the projectile and the projectile center of mass; and (b) a casing coupled to the projectile, wherein at least a portion of the tail fins are disposed within the casing.

2. The cartridge of claim 1, wherein the elongate body portion includes a nose section including an increasing taper along the longitudinal axis and a trailing section having a decreasing taper along the longitudinal axis.

3. The cartridge of claim 1, wherein the elongate body portion includes plurality of radially extending body portion fins.

4. The cartridge of claim 1, wherein the elongate body portion has a first density and the tail portion has second density, the second density being lower than first density.

5. The cartridge of claim 1, wherein a length of the elongate body portion is greater than a combined length of the stem and the tail portion.

6. The cartridge of claim 1, wherein tail fins have a diameter less than the bore caliber.

7. The cartridge of claim 1, wherein the leading edge of the tail fins defines an increasing radial dimension toward the rear end along the longitudinal axis.

8. The cartridge of claim 1, wherein the elongate body portion has a homogenous density.

9. The cartridge of claim 4, wherein the elongate body portion includes a first component having a third density and a second component having a fourth density, each of the third density and the fourth density being different from the first density.

10. The cartridge of claim 1, wherein the casing and the projectile define a charge volume within the casing.

11. The cartridge of claim 1, wherein the casing and the projectile define a charge volume within the casing and further comprising a solid propellant retained within the charge volume.

12. The cartridge of claim 1, wherein the transverse dimension is a diameter of the body portion.

13. The cartridge of claim 1, wherein at least a length of the tail portion includes a cavity extending along the longitudinal axis, and wherein the cavity includes at least a closed end.

14. A projectile for passing through a bore of a barrel of a firearm, the bore having a bore caliber, the projectile comprising:

(a) an elongate body portion having a body diameter and a first density, wherein the body diameter is a caliber diameter;

(b) a tail portion defining a rear end of the projectile and including a plurality of radially extending tail fins, the radially extending tail fins having a leading edge longitudinally intermediate the body portion and the rear end of the projectile; and (c) a stem connecting the body portion and the tail portion, wherein the stem has a stem diameter less than the body diameter;

wherein the body portion, the tail portion, and the stem are colinearly disposed along a longitudinal axis and define an integral one piece assembly with a projectile center of pressure and a projectile center of mass, the projectile center of pressure being longitudinally intermediate the rear end of the projectile and the projectile center of mass;

and wherein each tail fin includes at least two of a radial taper, a longitudinal taper, and a bottom surface.

15. The projectile of claim 14, wherein for each tail fin the leading edge of the tail fin has a smaller cross-sectional area than a trailing edge of the tail fin.

16. The projectile of claim 14, wherein the bottom surface connects two adjacent tail fins.

17. A projectile for passing through a bore of a barrel, the bore having a bore caliber, the projectile comprising:

(a) an elongate body portion extending along a longitudinal axis to define an elongate body portion length, the elongate body portion having a plurality of radially projecting body portion fins extending along the longitudinal axis, the body portion having a transverse dimension, wherein the transverse dimension is a bore caliber;

(b) a tail portion defining a rear end of the projectile and including a plurality of radially extending tail fins, the radially extending tail fins having a leading edge longitudinally intermediate the body portion and the rear end of the projectile; and (c) a stem connecting the body portion and the tail portion, wherein the stem has a stem diameter less than the body diameter; and wherein the body portion, the tail portion, and the stem are colinearly disposed along a longitudinal axis and define an integral one piece assembly with a projectile center of pressure and a projectile center of mass, the projectile center of pressure being longitudinally intermediate the rear end of the projectile and the projectile center of mass.

18. The projectile of claim 17, wherein the body portion fins terminate within the elongate body portion.

19. The projectile of claim 17, further comprising a barrel having a bore, wherein the bore has a cross section configured to slideably receive the projectile.

20. The projectile of claim 17, wherein the body portion fins extend along at least 25% of the elongate body portion length.

* * * * *